US006577247B2

(12) United States Patent
Giacaman

(10) Patent No.: US 6,577,247 B2
(45) Date of Patent: Jun. 10, 2003

(54) INTRINSICALLY SAFE TRAFFIC CONTROL SYSTEM, METHOD AND APPARATUS OPTIMIZED FOR INHERENT-POLARITY TRAFFIC SIGNALS

(76) Inventor: Miguel S. Giacaman, 331 Yerba Buena Rd., Apt. B, San Francisco, CA (US) 94130-1501

( * ) Notice: Subject to any disclaimer, the term of this patent is extended or adjusted under 35 U.S.C. 154(b) by 0 days.

(21) Appl. No.: 09/765,405

(22) Filed: Jan. 20, 2001

(65) Prior Publication Data

US 2002/0008636 A1 Jan. 24, 2002

Related U.S. Application Data

(60) Provisional application No. 60/177,116, filed on Jan. 20, 2000.

(51) Int. Cl.[7] ..... G08G 1/095
(52) U.S. Cl. ..... 340/907; 345/82
(58) Field of Search ..... 340/907, 815.45, 340/815.75; 345/46, 82, 83; 362/240, 800, 812

(56) References Cited

U.S. PATENT DOCUMENTS 4,271,408 A 6/1981 Teshima et al.
4,298,869 A 11/1981 Okuno
4,929,936 A * 5/1990 Friedman et al. ..... 345/117
4,954,822 A 9/1990 Borenstein
5,633,651 A * 5/1997 Carvajal et al. ..... 345/82
5,936,599 A * 8/1999 Reymond ..... 345/82

FOREIGN PATENT DOCUMENTS

EP 910934 4/1999

* cited by examiner

*Primary Examiner*—John Tweel
(74) *Attorney, Agent, or Firm*—Jay R. Yablon

(57) ABSTRACT

The present invention demonstrates that light-emitting diodes (LEDs) have electrical characteristics that can be used to dramatically reduce the complexity and cost of the traffic signaling equipment needed to control the array of signals to give the right of way to the vehicles in a given intersection. This also enhances the energy saving features of LEDs by relocating the power source to the traffic signal control system and the electric conditioning devices to the signal position, increasing the energy efficiency of the whole intersection. One benefit is 'intrinsic safety' based on a method for power distribution to the signals that does not allow failure modes that could cause accidents. The system ensures that simultaneous green or yellow signals on crossed streets are impossible even though the signals are connected to the same power lines, allowing also the use of a bus connection topology with a command driven control of the ON/OFF state for each individual light or signal. This 'phase conflict prevention' is safer and simpler than the prior art and also eliminates the need of the independent monitoring equipment usually required to prevent such hazardous conditions. Also there is a large reduction in the number of wires resulting in even greater controller simplicity due to the ability of controlling a larger number of signals with a given number of electric conductors than in the prior art.

60 Claims, 19 Drawing Sheets

Central Traffic Control System

Central Traffic Control System

Local Node, multiple signals

Local Node, multiple signals

INTRINSICALLY SAFE TRAFFIC CONTROL SYSTEM, METHOD AND APPARATUS OPTIMIZED FOR INHERENT-POLARITY TRAFFIC SIGNALS

CROSS-REFERENCE TO RELATED APPLICATIONS

The present application claims benefit from U.S. Provisional Application No. 60/177,116 filed Jan. 20, 2000 entitled "Intrinsically Safe Traffic Control System".

BACKGROUND OF THE INVENTION

The present invention relates to traffic signals. In particular, the invention relates to controllers for light-emitting diode (LED) based traffic signals.

The main objective of a traffic signal arrangement (FIG. 1) is to coordinate vehicular flow sequencing the right of way in an orderly manner for vehicles that cross or intersect each other.

The electronics equipment to control the traffic signals that are installed throughout the world includes a set of equipment 101 to 106 housed in a standard rack mounted near the street crossing that delivers power to each signal or group of signals. This is known as a "traffic signal controller system" which includes as its main elements a controller 101, 103, 104 that coordinates the timing of the ON and OFF state for each signal or group of signals 118 and 119 and a monitoring system 102, 105, 106 for safety purposes. Signals 118 and 119 are generally parts of a traffic signal array that is mounted on a pole in the intersection. The AC/DC signal converters 105, 106 are used to convert the AC signals on lines 108 and 109 into DC signals 114, 115 appropriate for monitoring by the monitoring system 102.

Because any malfunction (hardware or software) of any equipment inside the traffic signal controller system may cause a traffic accident, current systems have an autonomous and independent monitoring system 102 that senses the state (ON or OFF) of each signal 118, 119 (that may represent a group of signals) to determine if this is an allowed safe state. If an unsafe state is detected the monitoring system may send a disable signal 116 to the central controller 101 to shut down the controller or to enter some sort of safety default, such as flashing the red signal. An example of an unsafe state would be green or yellow lights on two crossing streets of an intersection turned on at the same time.

Essentially, in these systems for each signal 118, 119 there exists wiring for power 107, 108, 109 and wiring for monitoring 110, 111 associated with each light signal controlled by the traffic signal controller system forming a star topology.

The above mentioned topology becomes complex and expensive because of the large number of power and monitoring cables employed and the circuitry 103, 104, 105, 106 associated with each set of wires for each signal or group of signals.

An attempt may be made to simplify this state of the art equipment by using a unique power line in a bus (or loop) configuration and by delivering control signals to set the ON and OFF state at individual signals. Although this would save power lines, such a system would still require an additional communications network and a CPU controlled device at each signal light position to manage/monitor the ON and OFF state. In and of itself such a bus based control scheme does not preclude simultaneous conflicting ON states. Therefore a significant simplification would not be achieved because this system, being intrinsically unsafe, would still require the use of individual wiring from each signal to the monitoring system.

The emerging LED technology applied to traffic signals offers an outstanding energy saving and maintenance cost reduction due to their low operational temperature, monochromatic light emission and extraordinary life expectancy or mean time between failure (MTBF). New kinds of LED devices especially designed for the traffic signals market have been emerging lately and many products have been developed in order to retrofit this technology to the existing traffic signal controllers. But, it is clear that the state of the art in traffic signal control systems has not yet adapted to this new traffic signal technology, hence new control systems, devices, and methods will be described here that take advantage of the technical benefits these new LED signal devices offer.

SUMMARY OF THE INVENTION

The present invention solves the above-noted problems (and other problems more fully discussed in the relevant sections below) by providing an apparatus for controlling traffic signals that includes a control unit and a plurality of traffic signal arrays. The control unit includes a power supply that supplies direct-current power. The control unit also includes a high-efficiency AC-to-DC converter. The present invention uses the power polarity features of polar devices to control traffic signals, resulting in lessened cable requirements and intrinsic failsafe operation.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) in which:

DETAILED DESCRIPTION

Preliminarily, some definitions are provided:

The term "signal" has two meanings that may be determined from context and usage:

First, "signal" refers to a communication between components or devices that carries information, and is usually a voltage or current signal on a wire.

Figure 14:
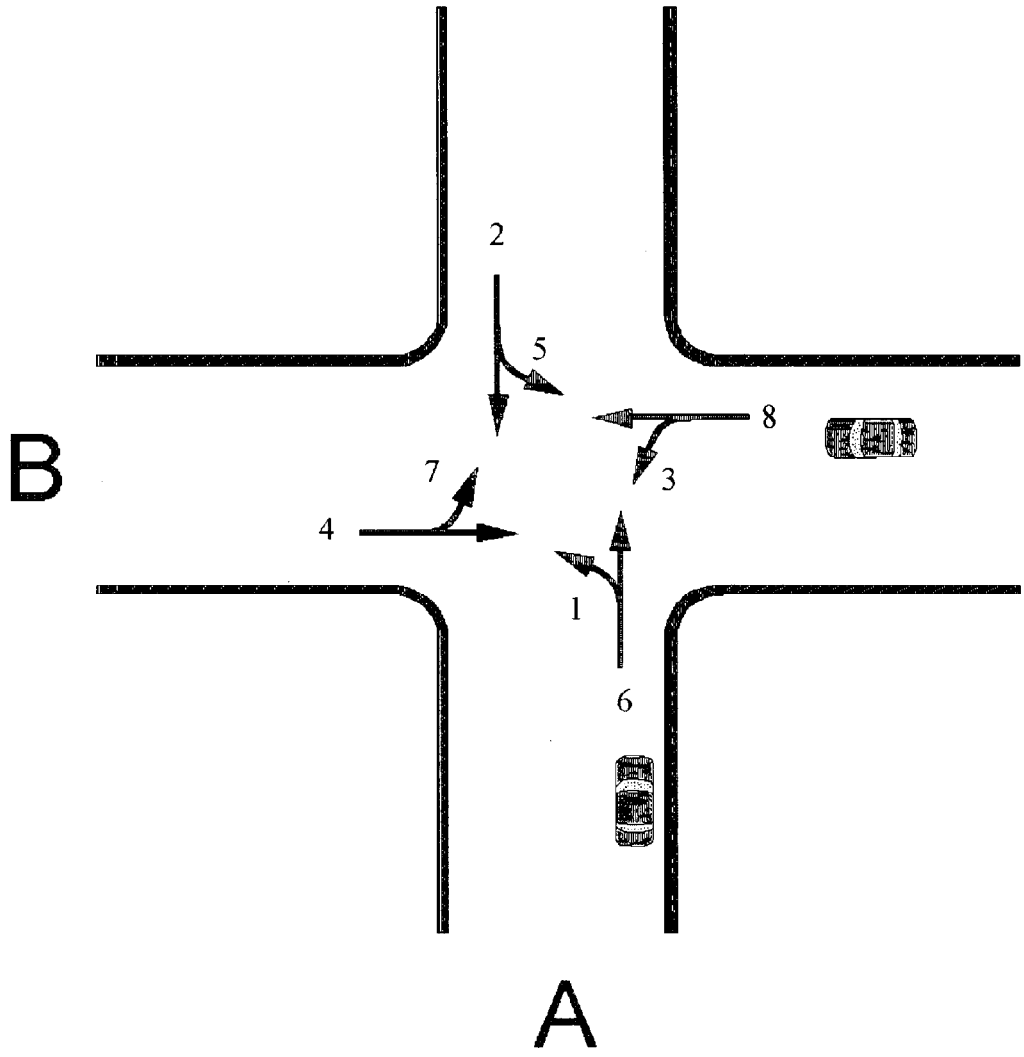
FIG. 14 is a pictorial representation of a reference intersection.

Second, "signal" refers to a generic traffic signaling device or group of devices that if they are in the same state (like ON or OFF) would not create a collision hazard, to comply with the latter, all of them should give the right of pass to traffic in the same direction, e.g.: in FIG. 14 are shown eight 'signals or groups of them' in which signal '6' means all the signal that give the right of pass to traffic coming from street A and crossing street B and signal '1' means all the signal that give the right off pass to traffic coming from street A and turning into street B. All such a 'signal or group of them' are shown in all figures and all along this document as a single LED and symbolized as a diode. In the cases where a standard diode is shown, the symbol of Schottky diodes are used. This allows differentiation of the two kinds of diodes and also because Schottky diodes are part of our preferred embodiment and their usage and advantages as energy efficient rectifiers is claimed as part of this invention.

Another issue is that 'collision hazard' refers to vehicles and/or pedestrians, so the pedestrian signals are usually connected to a 'signal or group of signals' that give the right of pass to traffic in the same direction as the pedestrians are crossing, avoiding a potential accident. As an example, pedestrians cross street B simultaneously as traffic from street A do. In FIG. 14, a pedestrian signal for crossing street B by the right side may be connected to traffic '6' 'signal or group of them' and for the left side may be connected to traffic '2'. An independent signal may be also used for pedestrian right of pass.

The term signal includes but are not limited to typical light bulb based traffic signals and newer technology based on devices like LED, LCD, cholesteric technology or any light emitting, reflecting or refracting devices that can be used now or in the future for traffic signaling.

The term "low voltage signal" refers to an electrically actuated traffic signal which is specified by the manufacturer to operate on a voltage level that is lower than a typical AC line voltage (e.g., 110 volts) or the voltage obtained after polarity rectification and/or filtering such AC line voltage. In order to supply the appropriate voltage to this kind of signal, power conversion is needed.

The term "polar type signal or device" ("inherently polarized traffic control signal") refers to an electrically actuated traffic signal or device, operates only when the applied voltage has a specified polarity connection (positive or negative). Since LED based lights have become the main 'new technology' used in traffic signals, and they are both low voltage and polar type devices, the control of these devices constitutes a main focus throughout this disclosure. However, as used herein, "inherently polarized traffic control signal" is understood to refer literally not only to LED devices, but to LCD, cholesteric technology or any light emitting, reflecting or refracting devices that can be used now or in the future for traffic signaling which is inherently polar, as well as to non-polar signals which are "retrofitted" to bring about suitable polarity, such as is discussed in FIG. 11.

For safety, it is preferred to use signals or devices (like LEDs or polarity inverters) that feature 'inherent' polarity as requirement to become operative.

The term "wiring" refers to the electric conductors used to connect the "traffic signal controller system" to the traffic signals array usually mounted on poles at the corners of an intersection.

The term "switch" or "polarity switch" refers to an 'electric switching device' or an 'electric polarity switching device' which could be any element that could perform the function of allow or block the flow of current to a signal or device in the system.

The following detailed description is generally organized as follows. First, a description of an existing system is given and its drawbacks are discussed. Second, the aspects of the present invention that overcomes these drawbacks is provided. This format is then repeated for each aspect of the present invention. However, note that these various aspects may be combined together as appropriate in suitable implementations of the present invention.

Low-Voltage DC System: Efficiency

Figure 1:
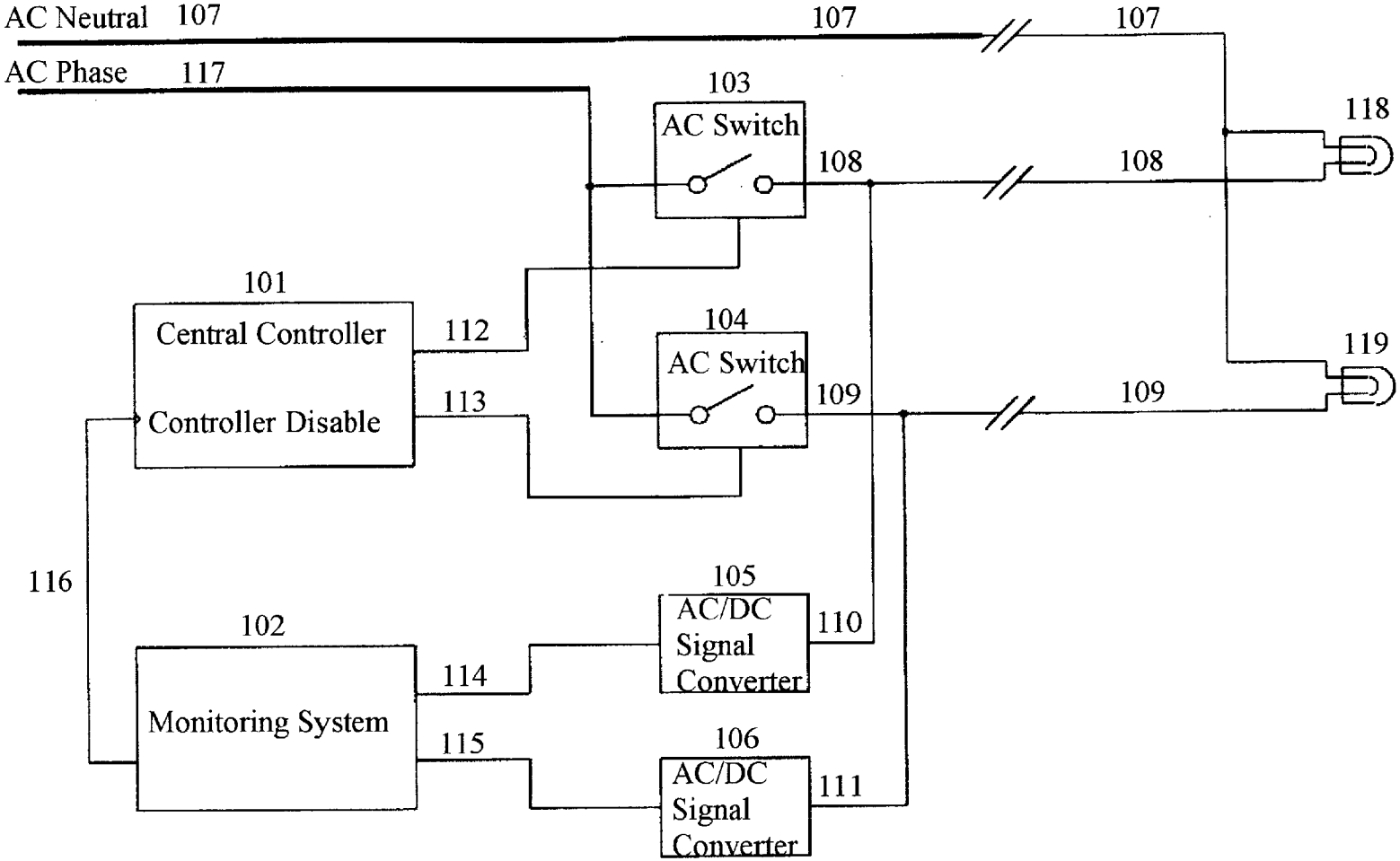
FIGURE 1 (PRIOR ART)
FIG. 1 is a block diagram of an existing bulb based traffic signal control system.
Figure 2:
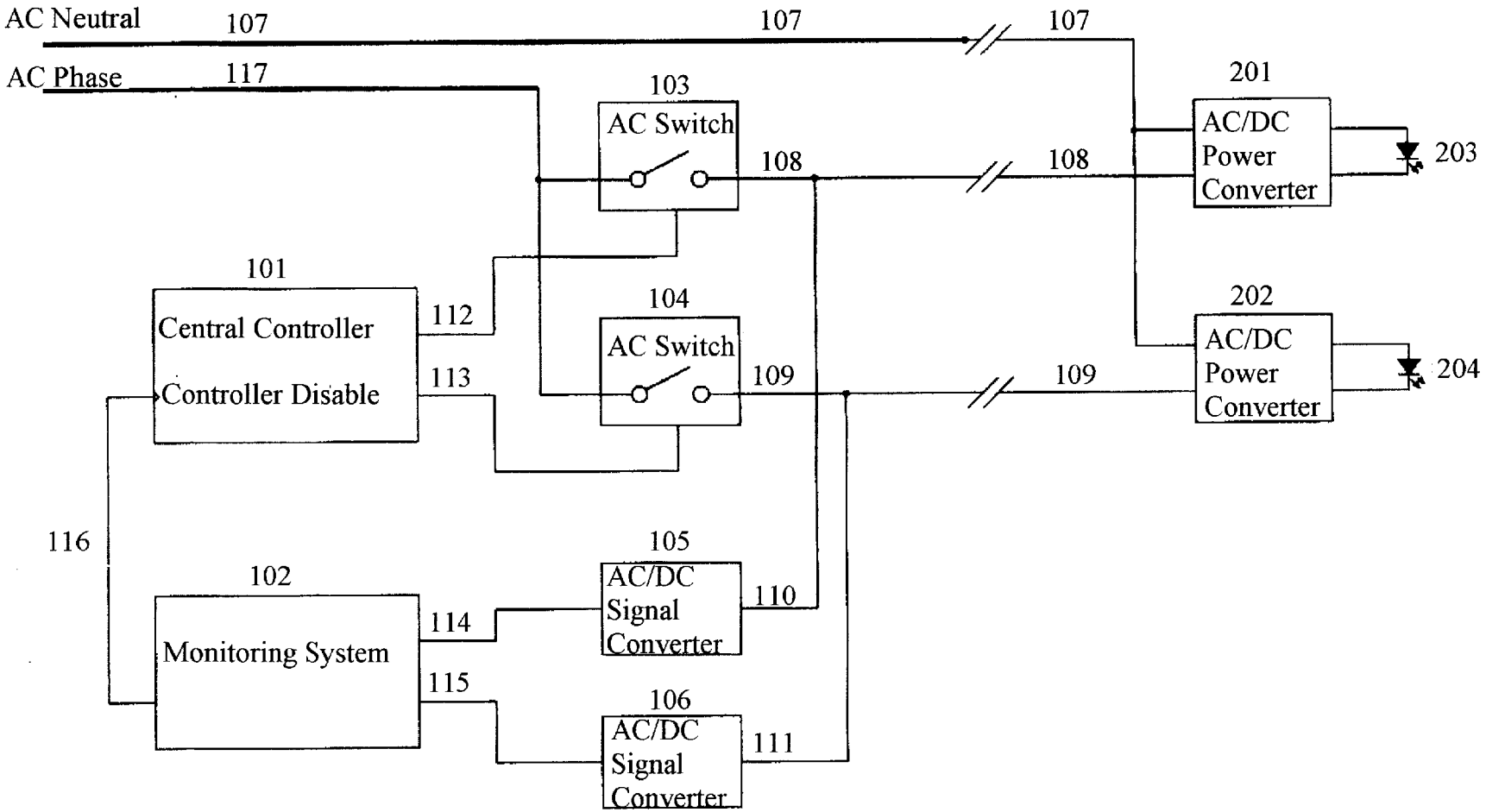
FIGURE 2 (PRIOR ART)
FIG. 2 is a block diagram of an existing LED retrofitted traffic signal control system.

FIG. 2 shows an exemplary existing traffic signal control system. Although modern traffic signals have being increasingly replacing bulb signals with LED based ones (compare FIG. 1 with FIG. 2), this has yielded an increase in price (an LED signal is several times more expensive than a bulb signal) and complexity, due to the addition of AC to DC power conversion 201, 202 which commonly includes current regulation and temperature compensation needed to get an LED signal to operate under the electrical specifications compatible with the ones for an AC line voltage bulb. Simply replacing bulb based signals with new electrically compatible LED based ones is typically referred to as a "retrofit".

The retrofit requires one local power converter 201, 202 for each individual signal 203, 204, usually housed together as one unit as in 201+203 and 202+204, called a traffic signal array. Since the cost of the converter (e.g., 201) is roughly one-fifth that of the LEDs associated therewith (e.g., 203), this cost is multiplied by the number of signals, which may exceed 100 for an extensive intersection.

The circuitry involved in the power conversion consumes more electrical energy than is needed for the signal itself, yielding about 70% to 80% conversion efficiency, resulting in increased energy consumption, heating and maintenance for typical converters 201, 202.

The basic LEDs life expectancy is also much higher than the local power converters 201 and 202, limiting the reliability of this retrofit assembly to that of the power converter.

The increase in equipment cost offsets the energy savings for up to 10 years or more in some countries (based on local electricity price).

If an attempt is made to increase the efficiency of the local power converter in the signal to over 90% to save even more energy, the added cost would approach that of the LEDs themselves, doubling the cost of the lamp, and thus the time needed to recoup the cost of upgrading from the projected energy savings.

Because the retrofit offers just long terms benefits, the use of LEDs has been limited mainly to the red signals in most installations worldwide, and the advantages of widespread, comprehensive LED signal upgrades have been significantly diminished.

Figure 3:
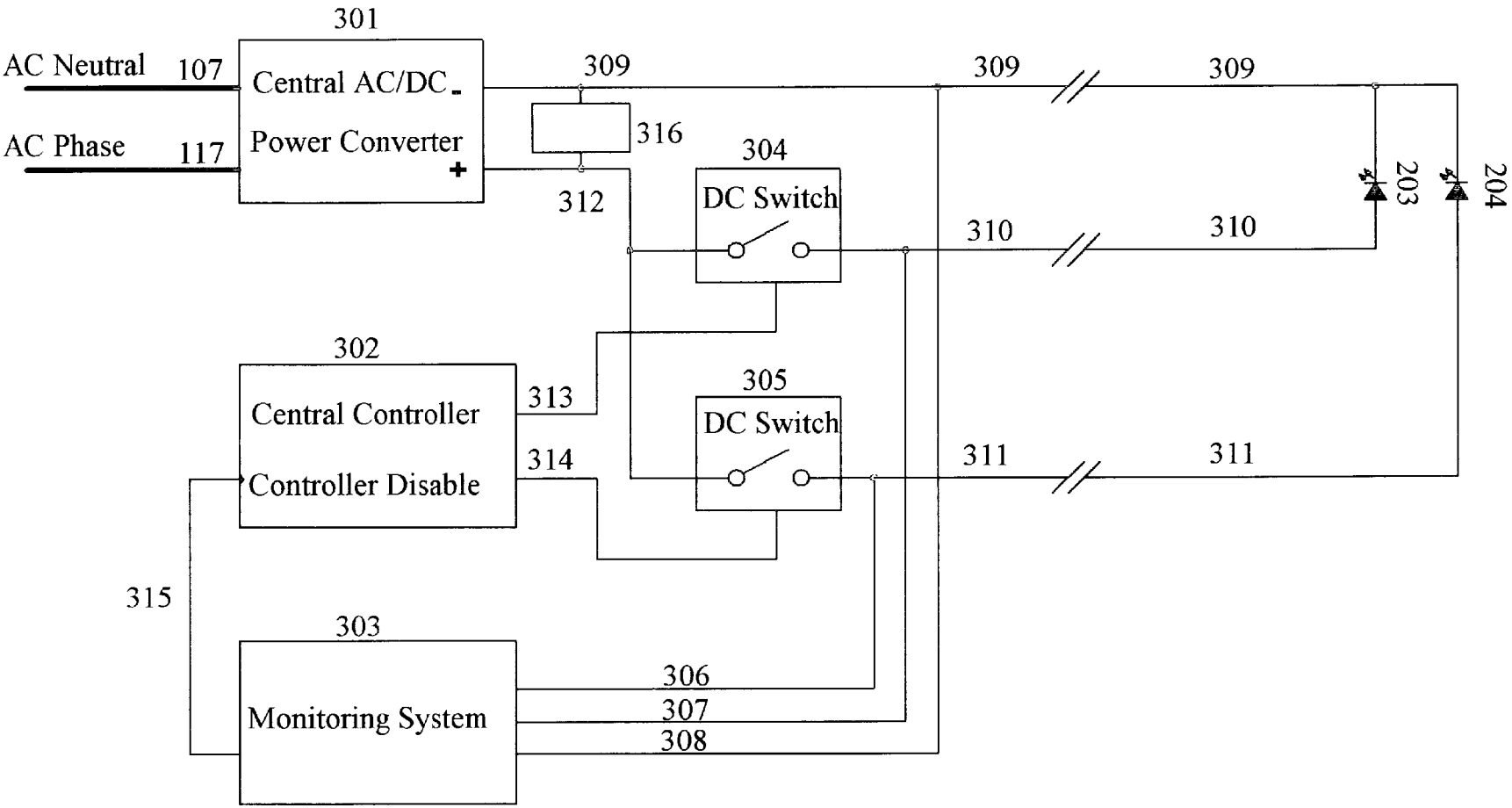
FIG. 3 is a block diagram of one embodiment of a traffic signal control system to show a Low-Voltage DC System according to the present invention.

FIG. 3 shows one aspect of the present invention that solves the above-noted problems. The low voltage DC traffic signal control system shown uses just one highly efficient (over 90%) high power central converter 301 to supply the whole LED signal array (which in a complex intersection may be over 100 signals) whose ON and OFF states are handled by a central controller 302 and low voltage, central control, DC power switches 304, 305 that transfer the low voltage DC power from the central converter output power lines 309, 312 to the signals 203, 204. The central converter 301 may also supply power to the control and monitoring equipment 302, 303, 304, 305.

This central converter 301 would have a manufacturing cost a few times higher than single low power and lower efficiency power converters 201, 202 (see FIG. 2) usually used in every one of up to 100 retrofitted signal assemblies that may be needed for a full LED based signal array. Thus, a cost savings may result. In addition, the central converter 301 has a longer lifespan than the less-expensive power converters 201, 202 (see FIG. 2) with corresponding reduced maintenance and service expenses.

This central converter 301 would increase the energy savings to an upper limit dictated by the state of the art in power conversion. Using just one central power conversion unit, instead of a large number of smaller power converters in each signal, will lower the cost of the signals themselves, reduce the maintenance and extend the life expectancy of the signal arrays up to the basic LED's reliability (MTBF).

It is important to consider that a bulb based traffic signal array consumes 2400 watts for 16 signals and 160 watts for the controller system. This means that the power consumption of the controller is a negligible 6.25%. But the bare LEDs 203 (without the power converter 201) in an array with 16 signals consume only 160 watts, in which case the power consumption for the controller becomes as high as 50% of the total system.

If the low voltage DC traffic signal control system described above is used it would add a negligible power consumption over the bare LEDs, even in a system as small as 16 signals. And, since the LEDs consumption is getting closer to the usable light (radiated power) then the use of such an energy optimized controller would take the energy saving for the whole system to a near theoretical limit.

Low-Voltage DC System: Monitoring System

Another drawback of FIG. 2 is that the controller 101 and monitoring equipment 102 have logic circuitry that work with low voltage DC (usually 5 volts DC), meaning that each low voltage DC line 112, 113, 114, 115 that is connected to a high voltage device to handle switches 103, 104 and signal converters 105 and 106, or to sense the high AC line voltage on 108, 109, 110, 111 should have high AC line voltage protection and/or isolation such as voltage surge absorbing devices, optical isolators, transformers and/or fuses in addition to the main elements: logic controlled power switches and power state sensors, all of them as part of the 'AC conditioning circuitry' 103, 104, 105, 106. Also, the retrofitted LED based signals assemblies 201, 203 and 202, 204 may have some incompatibility with the existing monitoring systems and may need additional compensation circuitry.

FIG. 3 shows that in a low voltage traffic signal control system according to the present invention, the monitoring system would be dramatically simplified from bulky and expensive high voltage AC equipment 102, 105 and 106 to a small, simple and inexpensive unit 303 with low voltage DC sensing lines 306, 307, 308 and featuring no voltage compatibility problems with low voltage polar type traffic signals 203, 204.

Low-Voltage DC System: Safety and Maintenance

Another main limitation of existing traffic signal control systems such as FIG. 2 is that they mostly work on high AC line voltage 107, 108, 109, requiring extensive safety regulations to be followed, duly trained and equipped maintenance personnel, complex wiring and installation to obtain the required safety, a bulky set of control and monitoring equipment, and a large housing rack. This results in the significant expense of electricity required to power all this electronic circuitry and a higher manufacturing, installation and maintenance cost.

The above may be contrasted with the invention embodiment shown in FIG. 3. Since the mentioned central power converter 301 has electrical and galvanic isolation from the high voltage AC line 107, 117 it offers a simpler installation and safer maintenance system from the output of the converter 309, 312 all the way to 302, 303, 304, 305, 306, 307, 308, 309, 310, 311 and including the signals themselves 203, 204.

Low-Voltage DC System: Battery Backup

Even though power outages are rare they can be a major problem that could affect whole cities for several hours and in some emergency periods or in developing countries may happen very often.

The solutions employed are either an UPS (uninterrupted power supply) for the whole intersection or, an UPS for the traffic signal controller system in conjunction with a local battery backup at each signal, or simply local battery backed up equipment that would just flash the red signals to warn drivers that the signaling is out of service.

For example, for an existing retrofit system such as FIG. 2, a UPS would be required that would have the capacity to supply sufficient AC power (usually at 110 volts). A UPS will, upon absence of AC line power, supply AC power by converting the low voltage DC power from a set of batteries kept constantly charged.

To generate AC line power from a set of batteries, complex and usually expensive electronics is needed which may be several times the combined cost of the batteries and charger, and even though these latter are bulky the converter may more than double this size, requiring a much larger enclosure. This is especially inefficient since it represents converting from low voltage DC (batteries) to high voltage AC only to be converted back down to low voltage DC in the signals.

Figure 6:
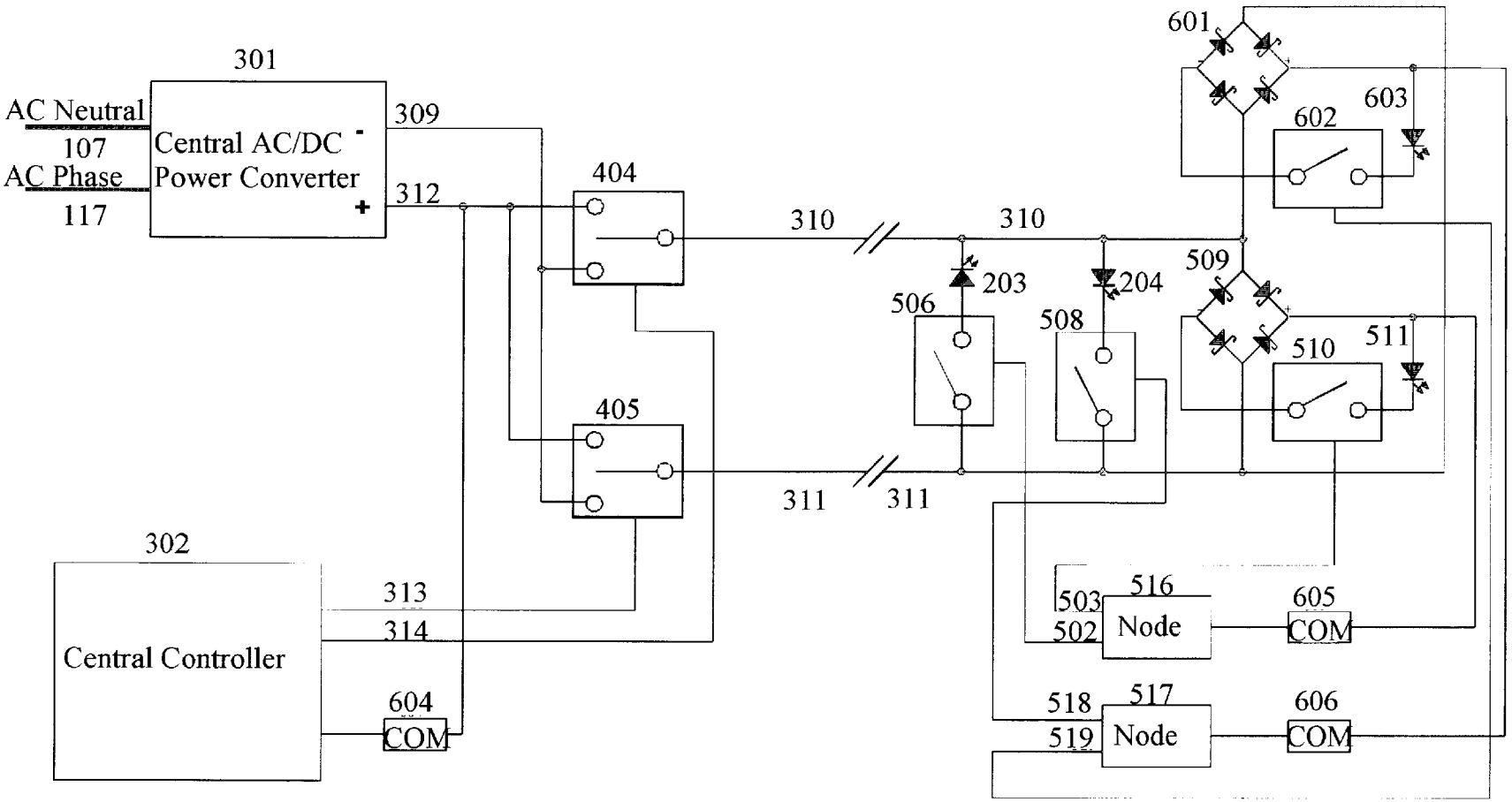
FIG. 6 is a block diagram of a fourth embodiment of a traffic signal control system to show the bus topology and line saving communication options according to the present invention.

FIG. 6 shows how the present invention overcomes these problems. A low voltage traffic signal control system does not need such a complex UPS, reducing the cost of the energy backup to the bare batteries and a charger 316 and supplying the whole intersection in a much more compact system and, since it is more energy efficient (DC to DC instead of AC to DC to AC), it would supply electricity for more time under the same power load, quantity and size of the batteries.

Reduced Cabling

FIG. 2 shows that in an existing system, the traffic signal control systems handle the ON or OFF state of the signals by switching the power supplied to them using at least one power line (e.g., 108 and 109, plus the common line 107) per signal.

Considering that cabling is also a relevant issue in the installation and maintenance costs it is important to reduce the number of lines to a minimum.

Figure 4:
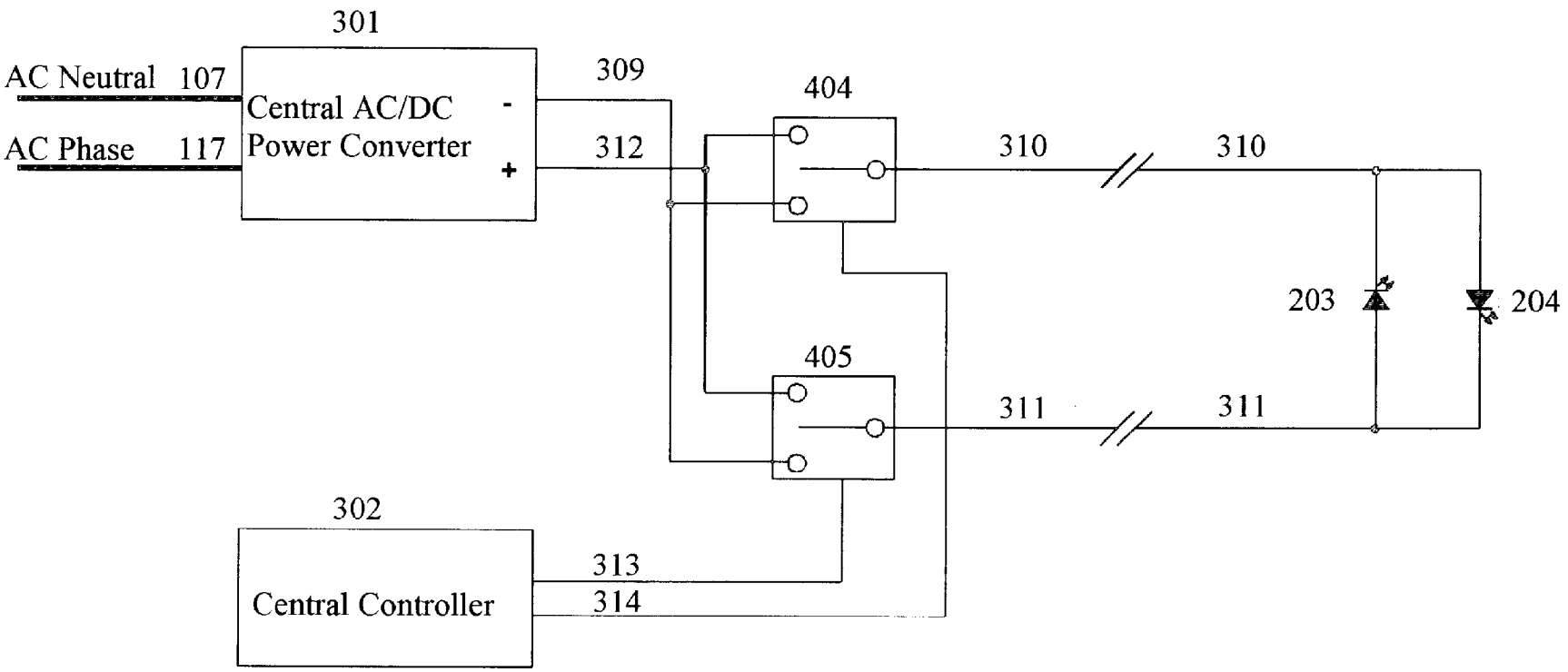
FIG. 4 is a block diagram of a second embodiment of a traffic signal control system to show the power line saving and intrinsic safety concept for two signals in a parallel connection according to the present invention.
Figure 7:
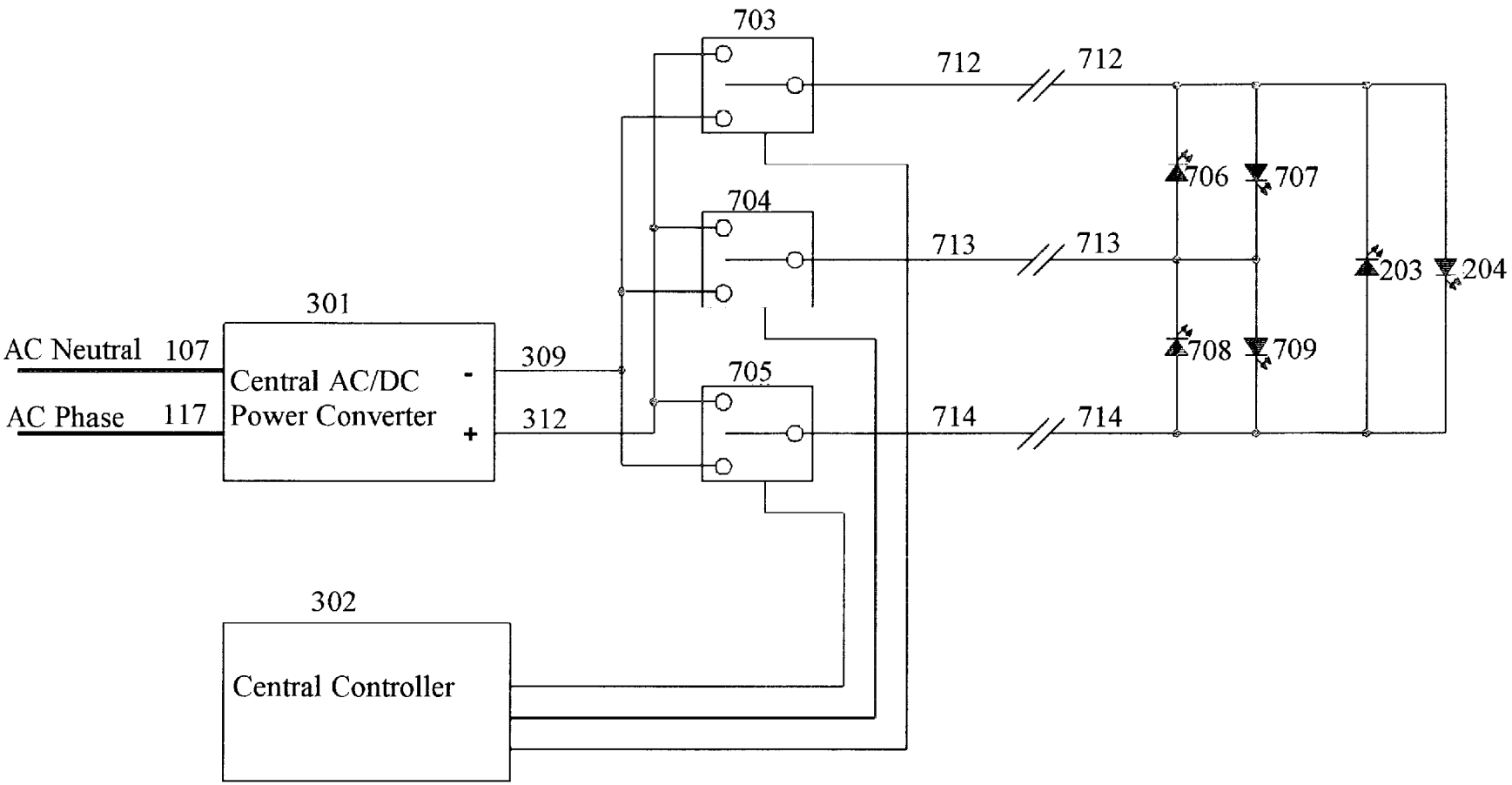
FIG. 7 is a block diagram of a fifth embodiment of a traffic signal control system to show the power line saving and intrinsic safety concept for six signals according to the present invention.
Figure 8:
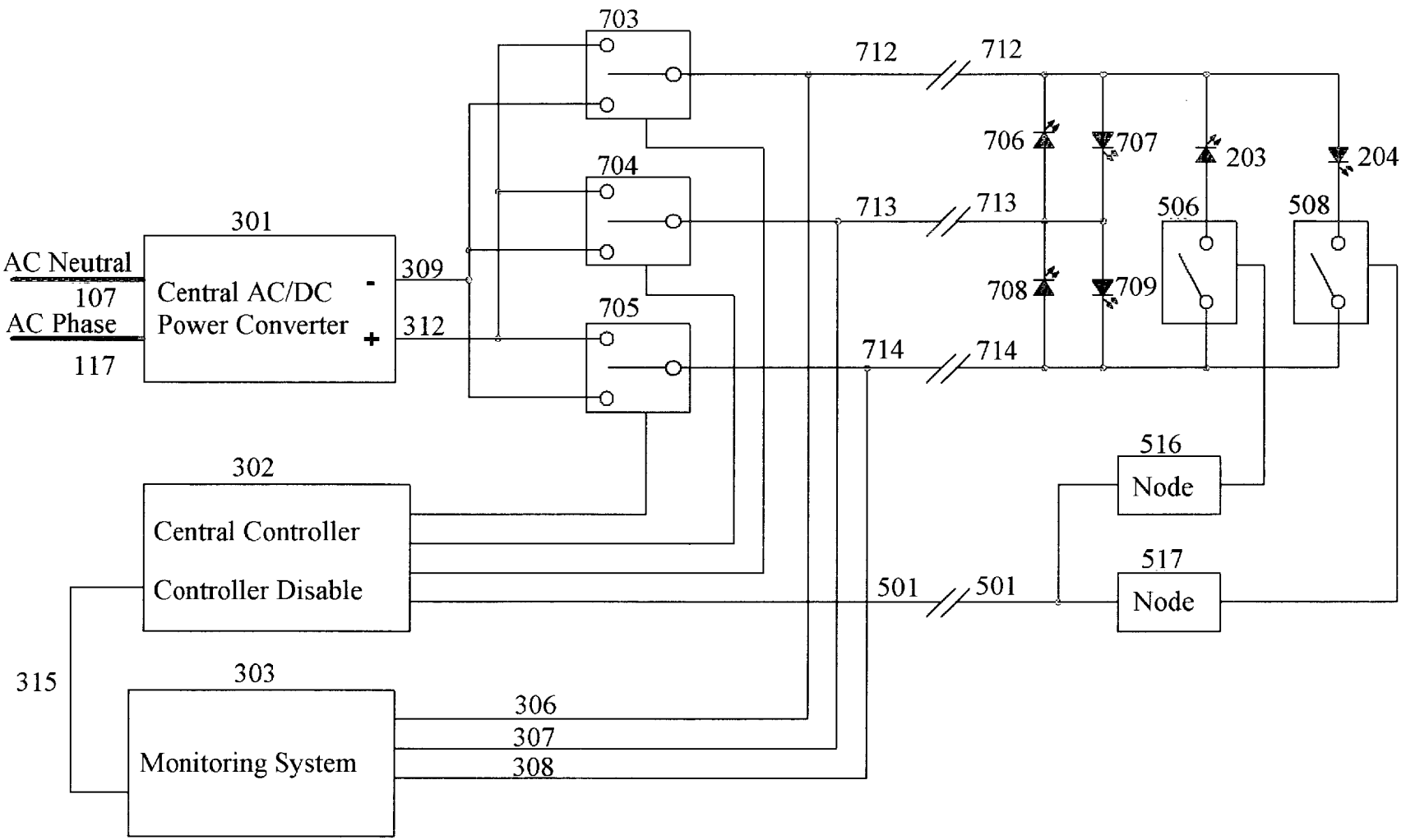
FIG. 8 is a block diagram of a sixth embodiment of a traffic signal control system to show the bus topology and phase blocking elements applied in the embodiment in FIG. 7 according to the present invention.

FIGS. 4 and 7 (and by extension to 5, 6, 8, 9A, 9B and 10) of the present invention show that to accomplish this, a new method for controlling the power supplied to an individual signal is proposed: using a power source 301 that delivers direct current (direct current flows in one direction only) whose outputs 309, 312 are connected through the signal controlled ON-OFF-ON switching arrangement (polarity switches 404, 405 in FIG. 4 and 703, 704, 705 in FIGS. 7 and 8) to a set of power distribution lines (310, 311 in FIG. 4 and 712, 713, 714 in FIGS. 7 and 8) to supply power to a set of polar type traffic signals (203, 204 in FIG. 4 and 203, 204, 706, 707, 708, 709 in FIGS. 7 and 8). Note that these pairs of inherently-polarized traffic control signals (203, 204 in FIG. 4 and 203, 204, 706, 707, 708, 709 in FIGS. 7 and 8) are connected relative to one another with opposite polarity orientation, in parallel to one another.

The connection of the power lines 309, 312 to any given signal may be selected with this switching arrangement to either polarity output of the central power supply. Polarity switchable power lines may be created, in which both the polarity and the power to each individual line can be switched: ON POSITIVE, ON NEGATIVE or OFF.

If a set of polar type traffic signals are connected to any given set of power lines, then for M cables such as 310, 311 in FIG. 4 and 712, 713, 714 in FIG. 7 running from the output end of polarity switches 404, 405 in FIG. 4 and 703, 704, 705 in FIG. 7 to one end of one or more pairs of inherently-polarized traffic control signals such as 203, 204 in FIG. 4 and 203, 204, 706, 707, 708, 709 in FIG. 7, the maximum X number of inherently-polarized traffic control signals that can be selectively supplied by these M cables in a minimum cabling configuration derives from the formula: $X=2*C(M,2)$ for $M>1$, which is 2 for M=2, 6 for M=3, 12 for M=4, 20 for M=5, and so forth. The number of traffic signal pairs is simply $P=C(M,2)$. That is, P is the number of combinations of M elements taken two at a time, which can be seen from FIG. 7 by observing how each cable supplies power to pairs of oppositely-polarized inherently polarized traffic signal connected in combinatorial manner with every other cable. Thus, in FIG. 7, the cable pairs (712, 713); (712, 714); and (713, 714) each connect one pair of oppositely oriented signals for a total of three pairs and six signals. Each individual cable delivers power to one end of M-1 traffic signal pairs each connected to a different one of the remaining M-1 cables. This type of combinatorial connection shown in the progression from FIG. 4 to FIG. 7 is generalized to any number of cables, when a minimal number of cables/maximum number of signals is a desired configuration.

If power of any given polarity is applied to two or more lines, then the maximum possible ON states of two or more signals is limited by this formula:

$Y=(2^M)-2$ for any given $M>1$. Thus, for M=2, Y=2; for M=3, Y=6; for M=4, Y=14; for M=5, Y=30; and so forth. An example of combination table that corresponds to M=4 is given in table 3.

Thus, Y=the maximum number of combination of signals in ON state for X signals to be controlled with this method and M number of power cables.

A central control system 302 can control the state of the signals or group of them by issuing the appropriate control signals to the ON-OFF-ON switches. The main application is to control complex intersections with several phases (for crossing and turning), however if in addition individual control is desired, a control bus and a local node topology may be applied.

If some particular combinations are to be excluded, then a simplified DC type monitoring system 303 may be used as in FIG. 8.

Intrinsic Safety

Among the main purposes of any traffic signal control system are 'coordination' of the right of way and 'safety' by preventing the allowance of such a right simultaneously to crossing traffic.

For this reason at least two sets of equipment are needed to establish a reliable solution, the controller 101, 103, 104 and the monitoring system 102, 105, 106 described above with reference to FIG. 1.

This safety relies both on the redundancy of equipment and the integrity of the manufacturer that should offer fully debugged and tested systems. This leads inevitably to very expensive control systems.

The present invention solves these problems as follows. As shown in FIG. 4, if only one pair of polar type traffic signals 203, 204 are oppositely connected (in parallel) to one pair of power lines 310, 311, then the above-described formula for X yields X=2 for M=2.

In this case, the power is supplied in either direction to two oppositely connected polar type signals each one responding to direct current with different and opposed direction.

Even with X=2 a power line savings is also achieved by controlling two signals with two lines, instead of the three needed if two power sources and one return line is used in a DC system (e.g., FIG. 3) or two hot phases and a neutral in an AC system (e.g., FIGS. 1 and 2).

But, one of the main contributions of this invention arises for the case when M=2 because in that case X=2 and Y=2 yielding a fundamental exclusion principle, meaning that two signals can have only two power combinations, so no simultaneous ON states are possible. If the latter is applied to supply power for two polar type traffic signals (or group of them) to give the right of way to crossing or intersecting traffic then an 'Intrinsically Safe' system is achieved.

Figure 10:
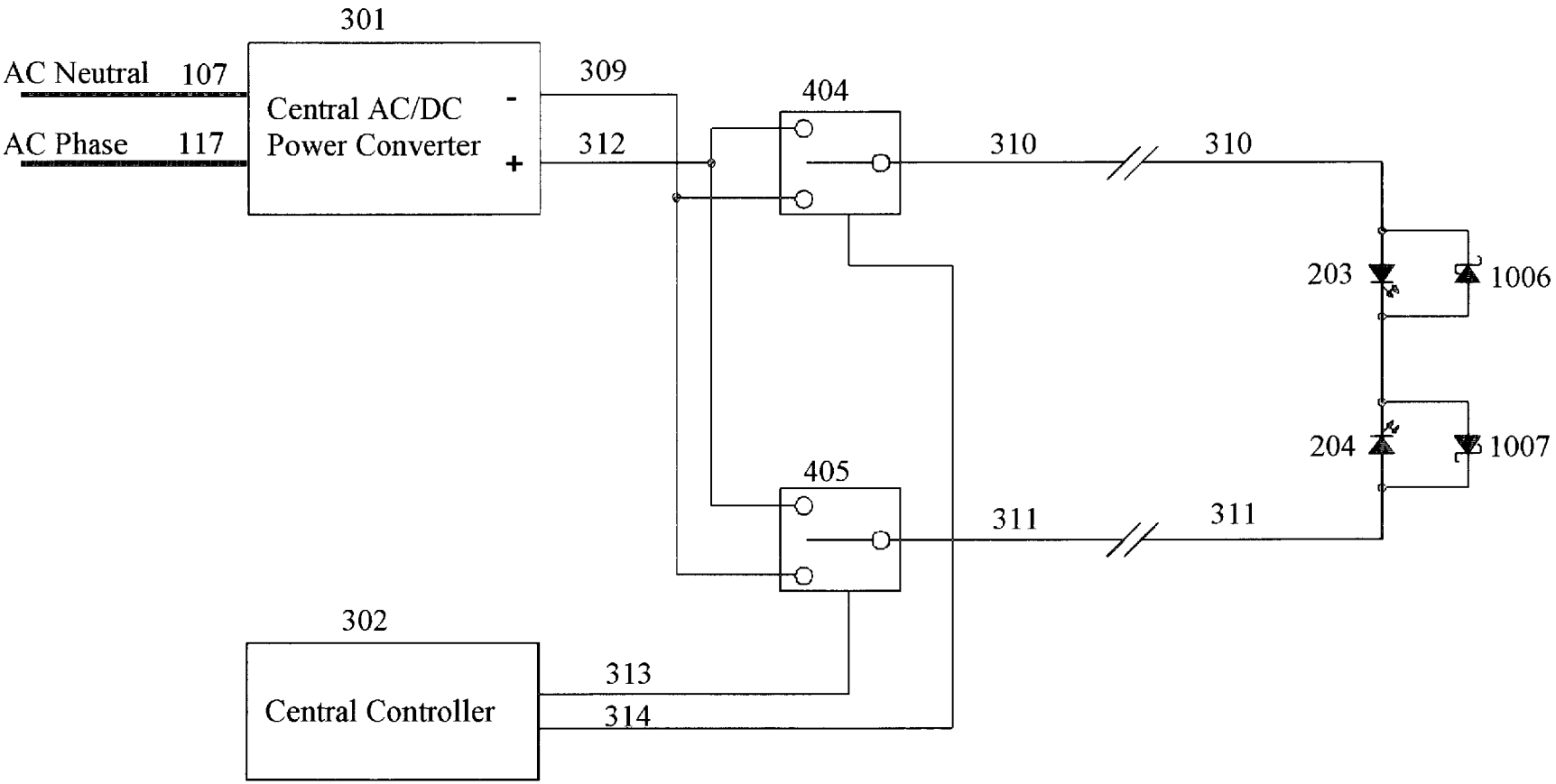
FIG. 10 is a block diagram of an eighth embodiment of a traffic signal control system to show the power line saving and intrinsic safety concepts for two signals in a series or 'loop' connection according to the present invention.

As shown in FIG. 10, if only one pair of polar type traffic signals 203, 204 are oppositely connected (in series) to one pair of power lines 310, 311, then bypass diodes 1006, 1007 are needed to assure the power lines 310 and 311 in a closed circuit, and the above mentioned exclusion principle and intrinsic safety are valid too. In this configuration, first bypass diode 1006 is connected in parallel with, and in opposite polarity orientation relative to, inherently-polarized traffic control signal 203. Second bypass diode 1007 is connected in parallel with, and in opposite polarity orientation relative to, inherently-polarized traffic control signal 204. The oppositely polarized parallel combination of inherently-polarized traffic control signal 203 with first bypass diode 1006 is connected in series with the oppositely polarized parallel combination of inherently-polarized traffic control signal 204 with second bypass diode 1007, such that inherently-polarized traffic control signals 203 and 204 are connected in this series with said opposite polarity orientation relative to one another.

The power source and traffic signals can be connected in such a way that it is impossible to have any green or yellow signals on crossed (opposed) streets being ON at the same time. The controller will coordinate the right of way to each of the crossing traffic, but even in case of any failure of the hardware or the coordination software it cannot override the safety layer imposed by the power distribution method based on direct current, a polarity inverter and polar type signals. This establishes a physically wired safety layer at the power source level in which no matter what the control system does, it cannot create an unsafe combination of traffic signals.

Therefore, this invention offers greater safety than any others that rely on an independent monitoring system, thus eliminating the need for it. This system provides great improvements in safety, economy, complexity and wiring with respect to current systems.

Figure 11:
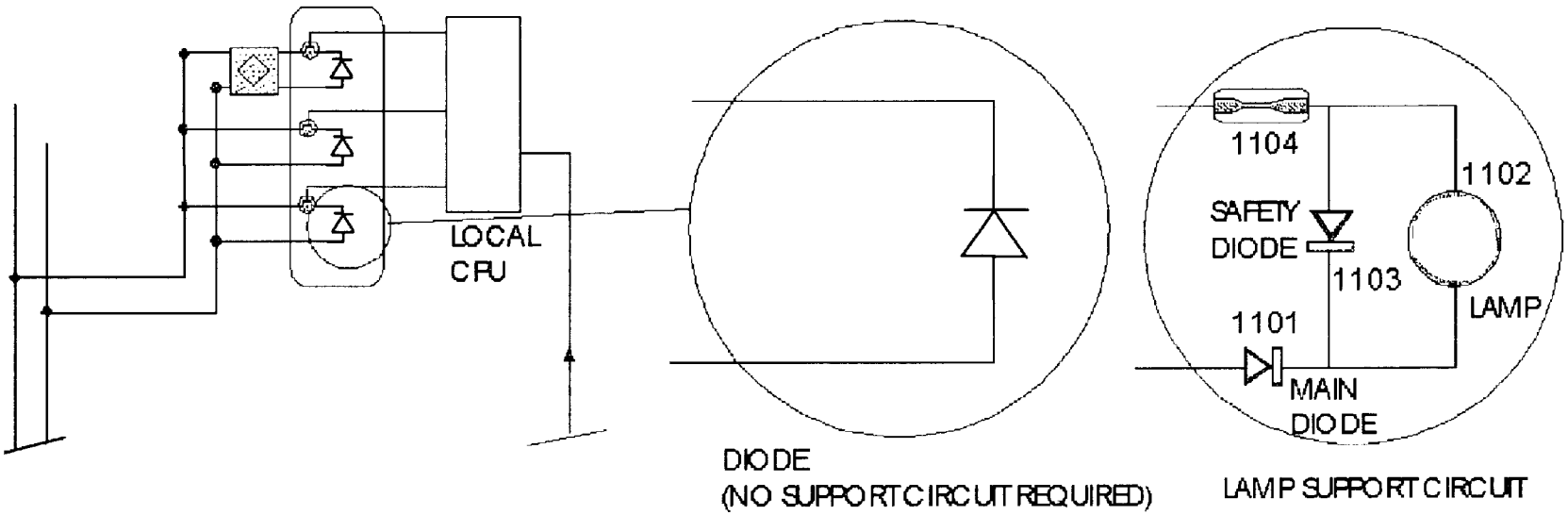
FIG. 11 is a block diagram of a ninth embodiment of a traffic signal control system to show a method to add 'inherently' polar characteristic to a non-polar signal according to the present invention.

Even though this method is preferably implemented with polar type signals (that exhibit inherent polarity), the method shown in FIG. 11 for polarizing non-polar devices may be used to convert bulbs or other similar signals to inherently polar ones. This is especially useful in cases where a gradual upgrade to LEDs is desired or when one of the colors of the LEDs, like the yellow LED signal in some regions, does not meet the official requirements (e.g., for minimum luminosity).

As shown in FIG. 11, if just a polar device 1101 (such as a diode) is connected in series with a non-polar signal 1102 (such as a bulb) then obviously this pair will behave (at first sight) as a polar type device. But if the polar device 1101 fails, it may lose its polar characteristics allowing the non-polar device 1102 to operate in either polarity. So it is not safe enough to ensure that no operation is possible if opposed polarity is applied.

However, according to an aspect of the present invention, an additional polar device 1103 may be connected in parallel with the signal 1102 and with opposite polarity with respect to the intended one, so if opposed polarity is applied (by failure of a main diode 1101 upstream from safety diode 1103), then the safety diode 1103 becomes conductive, causing a short circuit and avoiding any energy to be applied to the non-polar signal 1102. Since such a short circuit may be hazardous, an upstream current breaking device 1104 such as, but not limited to, a fuse is strongly recommended.

Another option is to use two diodes in series presenting a duplicate of the polar barrier, or use a diode with an electronic characteristic that assures that in case of failure it will become an open circuit and under any circumstances would become conductive reverse polarized.

Figure 13:
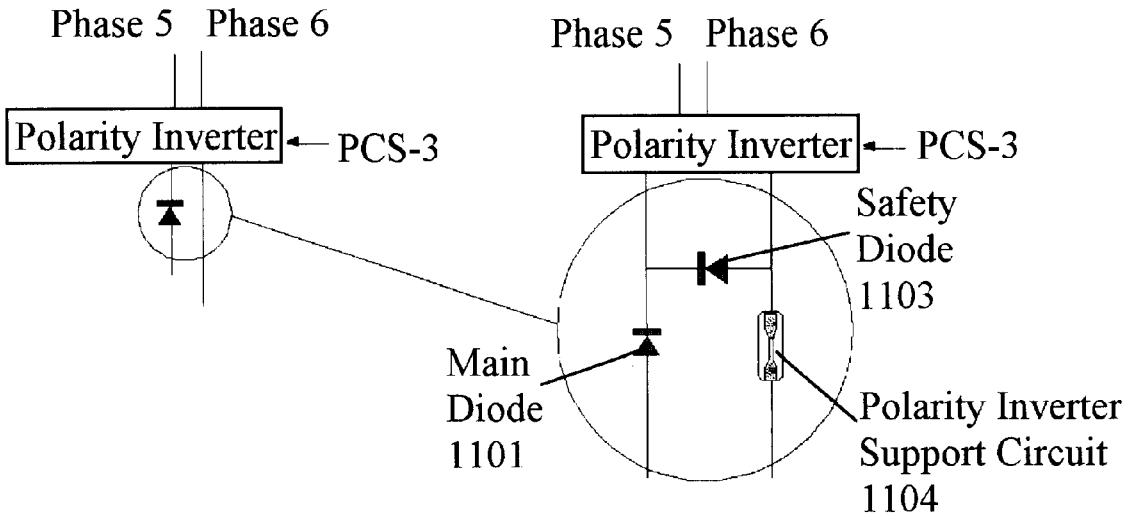
FIG. 13 is a block diagram of a tenth embodiment of a traffic signal control system to show a method to add 'inherently' polar characteristics to a polarity inverter according to the present invention.

FIG. 13 shows a variation of FIG. 11 in which the object of polarization is applied to a polarity inverter (instead of the non-polar signal 1102 as in FIG. 11).

(It is important to note that the concept of being 'intrinsically safe' is due to the fact that this new system is safe by itself with respect to the mentioned collision hazard prevention, and should not be associated with the popular concept of being 'intrinsically safe' for explosion prevention regulations commonly used to describe a potentially explosive environment by making equipment or devices in such a way that they cannot generate the minimum energy required to ignite any explosive material or gas expected to be present in the environment in which they are installed.).

In any case, if a signal is to be connected to any pair of power lines that are part of an 'intrinsically safe' arrangement a polarity rectifier 509, 601 (like a bridge type) may be used to allow a signal 511, 603 to be active without restrictions, as is useful for the stop signal (red).

High frequency power diodes, such as "Schottky diodes", feature low voltage dropout and are meant to be used in application like switching power supplies, where its speed is the relevant characteristic.

But, if they are to be in series with the current circulation path for a polar signal like LEDs which present a significant current figure, then an energy saving is achieved. For that reason, it is preferred that diodes such as 509, 514, 515, 601, 904, 906, 926, 928, 1006, 1007, 1101, 1103 comprise high frequency power diodes, and particularly, Schottky diodes. The use of a low-dropout voltage diode is thus suitable whenever a diode is placed in series with a high-current flow path such as, for example, power converter 301, polar and non-polar traffic control signals, polarity rectifiers such as 509 and 601, and batteries and chargers 316.

Figure 5:
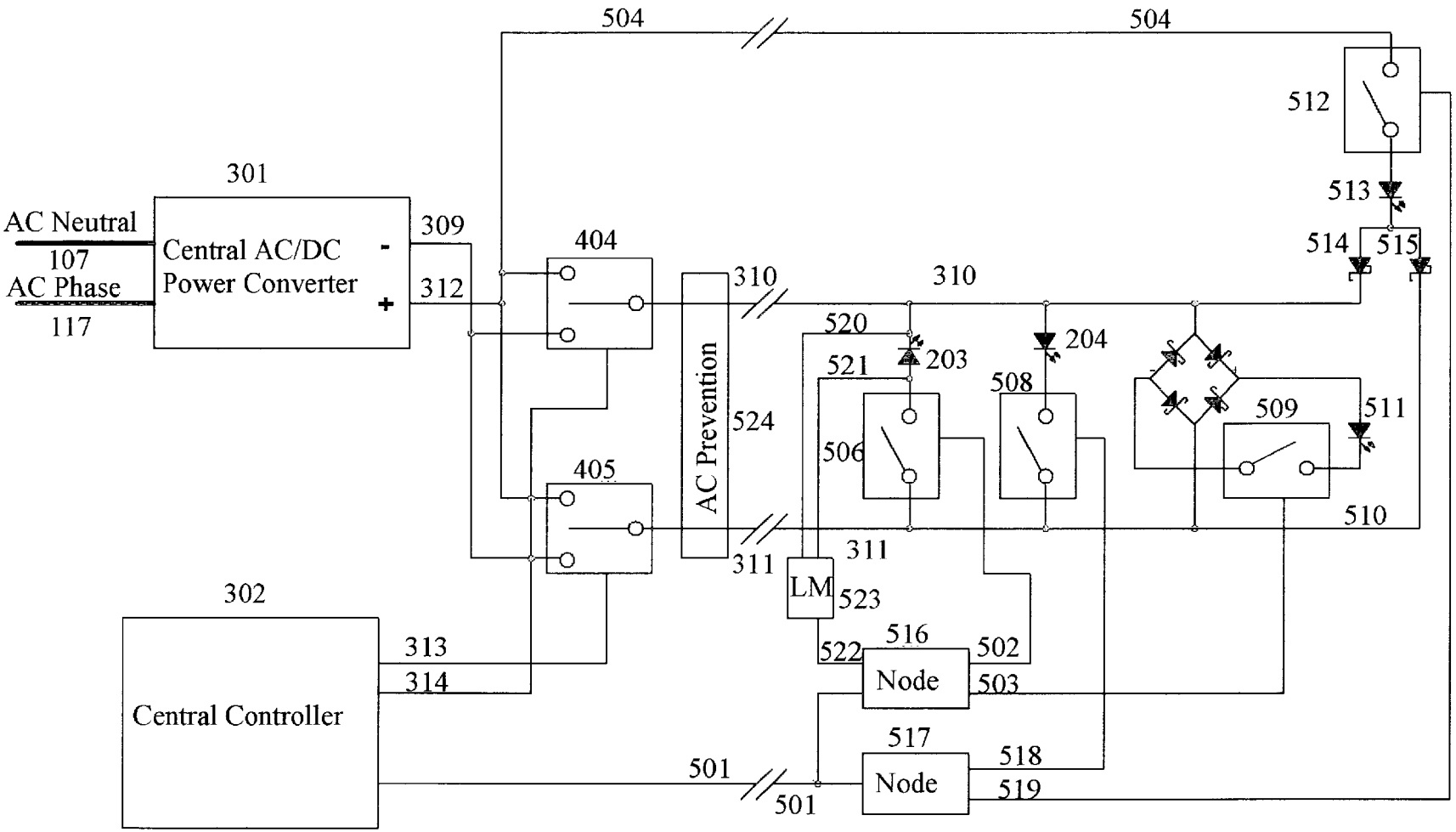
FIG. 5 is a block diagram of a third embodiment of a traffic signal control system to show the bus topology and its elements according to the present invention.

FIG. 5 shows that associated to any pair of power lines an AC prevention device 524 may be included to ensure that high frequency of polarity inversion is not possible. This case may be considered to avoid any apparent simultaneously ON states due to the retinal persistence in the human eye.

Figure 9A:
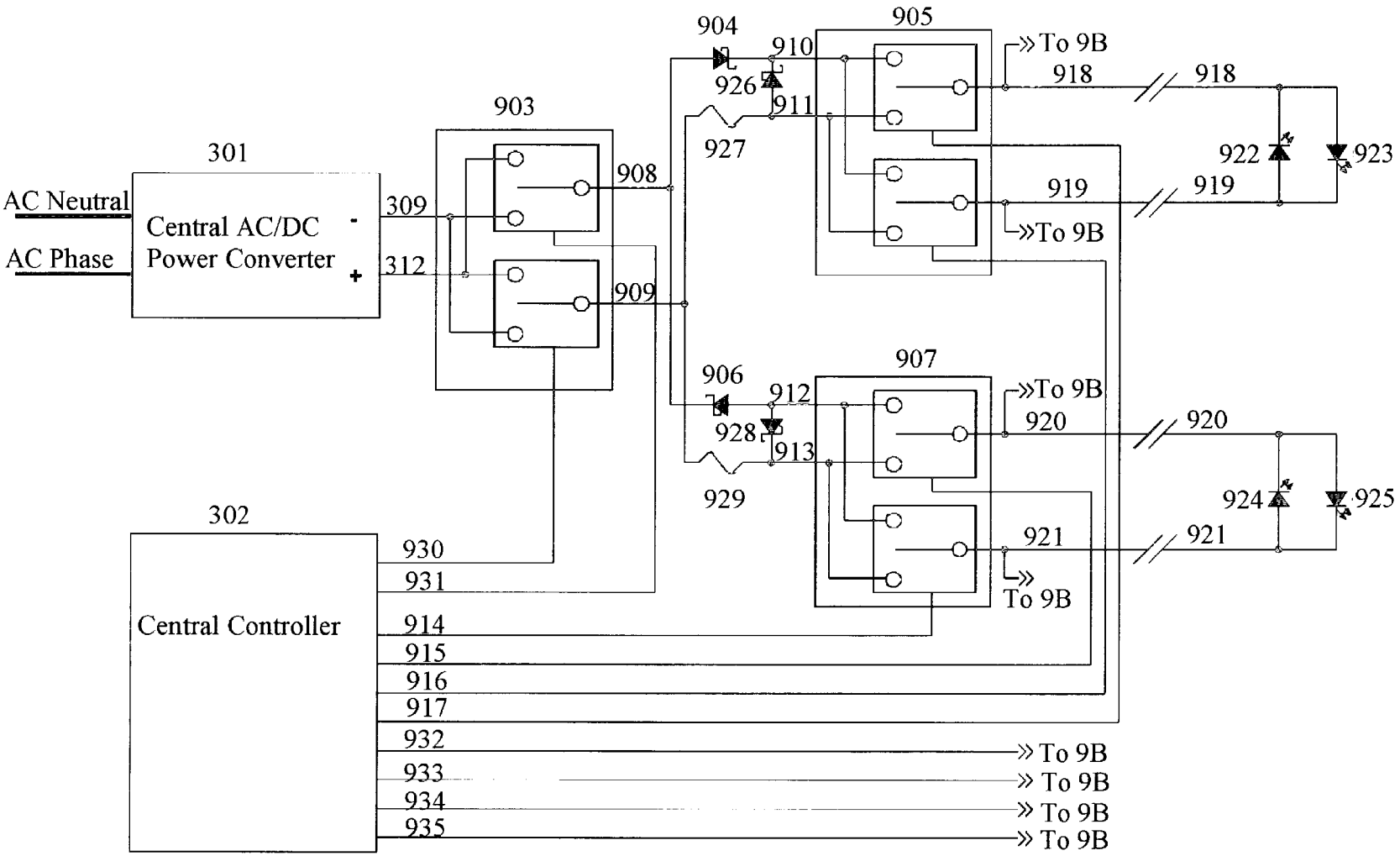
FIGS. 9A and 9B are block diagrams of a seventh embodiment of a traffic signal control system in which one particular arrangement of elements in this invention is used to show the intrinsic safety concept for the eight signals used to symbolize the eight phases shown in the reference intersection in FIG. 14, according to the present invention.

As shown in FIG. 9A, if considered as one block the pair of DC switches that form 903 may be seen as a polarity inverter. If the method for converting non-polar devices into inherently polar ones (such as shown in FIG. 13) is applied to 905 and 907 by adding 904, 926, 927, 906, 928, 929 to their power inputs 910 to 913, then they could be connected to as if they were a polar signal to 908 and 909 and upon a control signal 914 to 917 they could invert their output polarity and generate additional pairs of power lines 918 to 921 capable of supply power to two pairs of polar signals 922 to 925 in an intrinsically safe arrangement. While FIG. 9A shows using 904, 926, 927, 906, 928, 929 to retrofit non-polar 905 and 907 to inherently polar devices, it is understood that non-retrofitted (off-the-shelf) inherently polar polarity inverters may alternatively be employed to equal effect.

For this case, where M=2 a branching technique may be used to generate multiple phases wherein any signal is substituted with yet another inherently polar' polarity inverter whose power output is also of order M=2 and would only be powered up in one of the exclusive states. It would receive bus commands to determine which state to generate on its two output lines. In this manner, two secondary 'inherently polar' polarity inverters may control up to four tertiary ones and so forth. For the general case P inherently polar' polarity inverters of order M=2 may create 2*P states each one exclusive of all others and thus extremely intrinsically safe.

Figure 9B:
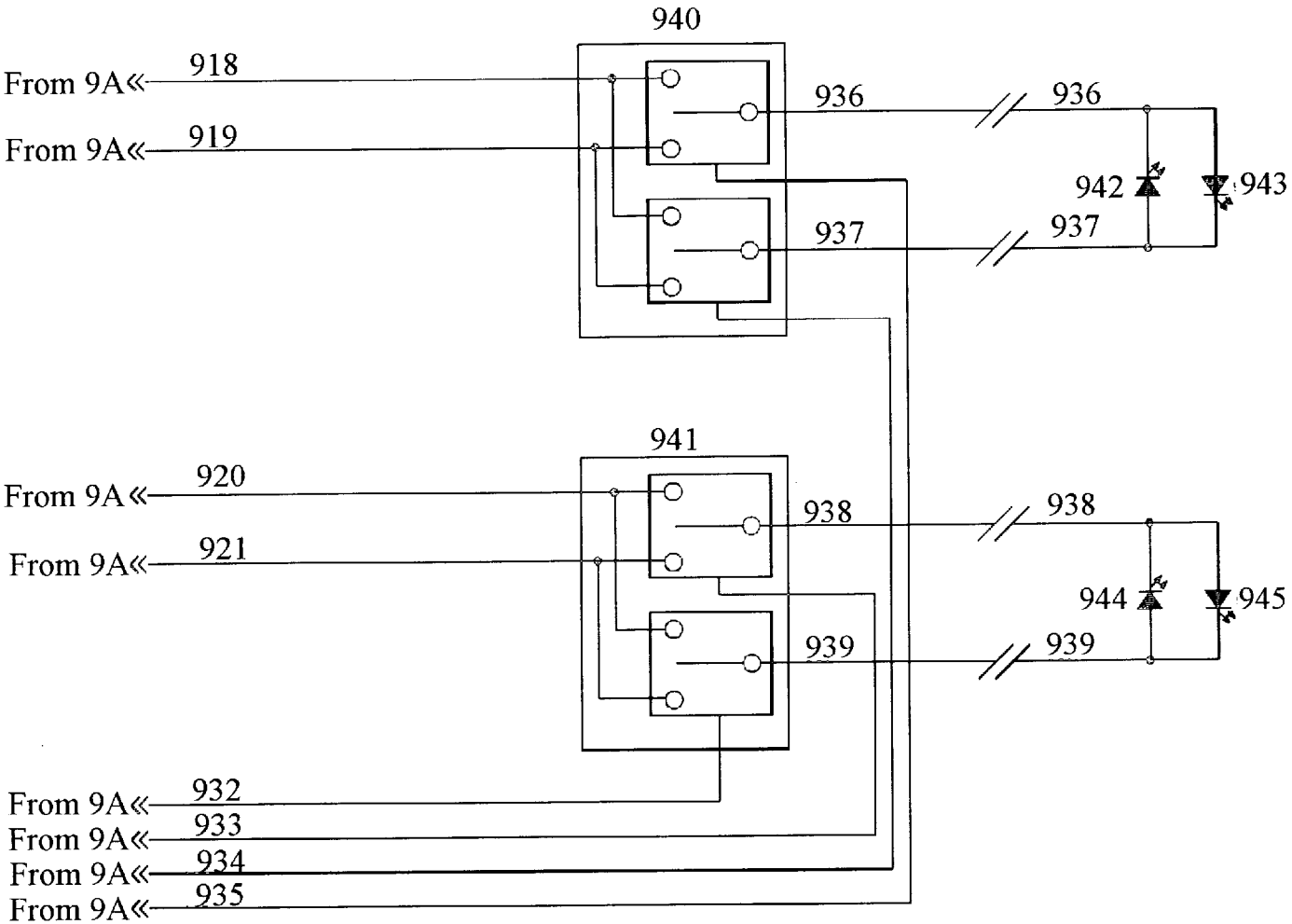

In the FIG. 9A is shown four exclusive (one out of four) phase signals 922, 923, 924, 925 and in FIG. 9B the outputs 918, 919, 920, 921 of the inverters 905, 907 are connected to the inputs of two inverters 940, 941 without the polarization devices used in FIG. 9A. Thus, two pairs of phase signals 942, 943 and 944, 945 are added which are nonexclusive with their corresponding ones in FIG. 9A. This means that just one pair of phases in FIG. 9B may be active simultaneously, but intrinsically excluded between themselves (e.g. 942 or 943), with just one phase in FIG. 9A (e.g. 922 or 923) which are mutually excluded too. The allowed safe combinations, shown in table 1, matches the collision avoidance requirements in the reference intersection shown in FIG. 14.

It is noted that FIGS. 9A and 9B are specified in general by observing that each non-inherently-polar polarity inverter drives an inherently polar device (either an inherently-polar polarity inverter or an inherent-polarity traffic signal pair), and each inherently-polar polarity inverter drives an inherent-polarity traffic signal pair as well as yet another (inherently-polar or non-inherently-polar) polarity inverter.

This extends the 'Intrinsic Safety' concept to a more complex intersection. The arrangement of FIG. 9A plus FIG. 9B as one system may control a typical 8 phases intersection in which a specific combination of phases are allowed, as shown in Table 1.

It is important to remark that in both the prior art system as is shown in FIGS. 1 and 2, and the non-prior art shown in FIG. 3, the control of the state of each signal is achieved by controlling the presence or absence of voltage in the power lines. If a power line connected to a signal that is supposed to be OFF becomes in electric contact with another line in ON state, then the OFF signal becomes ON, causing a collision hazard combination of phases. The same problem may happen if one of the AC 103 to 106 or DC 404, 405 power switches becomes permanently ON (because of failure) preventing the controller from turning OFF a signal as a consequence of a change of active phases.

Bus Topology

One of the issues that limits any attempt to simplify the current systems such as FIGS. 1 and 2 is the fact that each signal is controlled by switching ON and OFF its supply of power from the AC line by the central controller and, as explained in the "Background of the Invention" a bus topology is currently not a solution.

To solve these problems, FIG. 5 shows that if any of two signals or signal groups are arranged in an Intrinsically Safe configuration then a bus topology could be safely implemented by adding a local control switch 506, 508 driven by a control signal to each individual signal 203, 204 in order to implement selective control.

The commands may be sent from the central controller through, for example, a dedicated serial communication line 501 to 'nodes' 516, 517 (which are essentially computer processors) with local circuitry 506, 508 to control each signal 203, 204 according to a command driven protocol to individually control the state of each one, keeping the cable count low and the installation simple. Additionally the nodes 516, 517 may return information to the central controller such as status, history, diagnostics, faults, etc.

This bus topology is particularly useful in complex intersections where the control of phases for crossing and for turning may be needed.

When a multiple phase arrangement is desired then the safety needed to prevent a collision in crossing streets can be covered by the intrinsically safe system. The safety for the turning (or line of sight phases) may be solved by a signal state sensor connected to the node circuitry, which will double as a local monitoring device 523 to inform the central controller over the bus of any erroneous state of the signal, and in particular for safety, to determine that the signal is indeed off when it should be off, and for operations and maintenance, to detect the failure of some elements of a particular LED-based signal. In one embodiment, the state of the signal can be sensed by monitoring the light emitted from the signal. Alternatively, it can be sensed by monitoring the electrical properties such as voltage and/or current at the power input of the signal.

Even though the system ensures no hazardous traffic signaling, a hardware or software failure may require disabling of the right of way signals. It would be useful to have the capability of flashing all stop (red) signals to warn drivers that traffic coordination is out of order.

To achieve this, additional power lines may be utilized to supply power to stop signals. The stop signal should flash when a system malfunction is detected or according to the presence or absence of power in the right of way (green and yellow) signal power lines. If power line saving is desired, one line 504 could supply the stop signals 513 with one polarity and the other polarity could derive from a set of diodes 514, 515 connected to two or more power lines 310, 311 used normally for the coordination signal.

In order to avoid adding even a single wire, the communication system can be embedded in the power lines sending and receiving the commands by a modulation and demodulation of an AC waveform over the power lines. In FIG. 6 such in-line communication devices are represented by 'COM' as in 604, 605, 606. A radio frequency or infrared or other wireless communication is also applicable.

Then, the use of a bus configuration becomes even safer than any system in use as of today and yields a more advanced solution, simpler in installation and significantly more economical to manufacture.

This bus topology can be implemented as a bus with parallel connection of the signals, or as a loop with serially connected signals or a mix of them.

Figure 12:
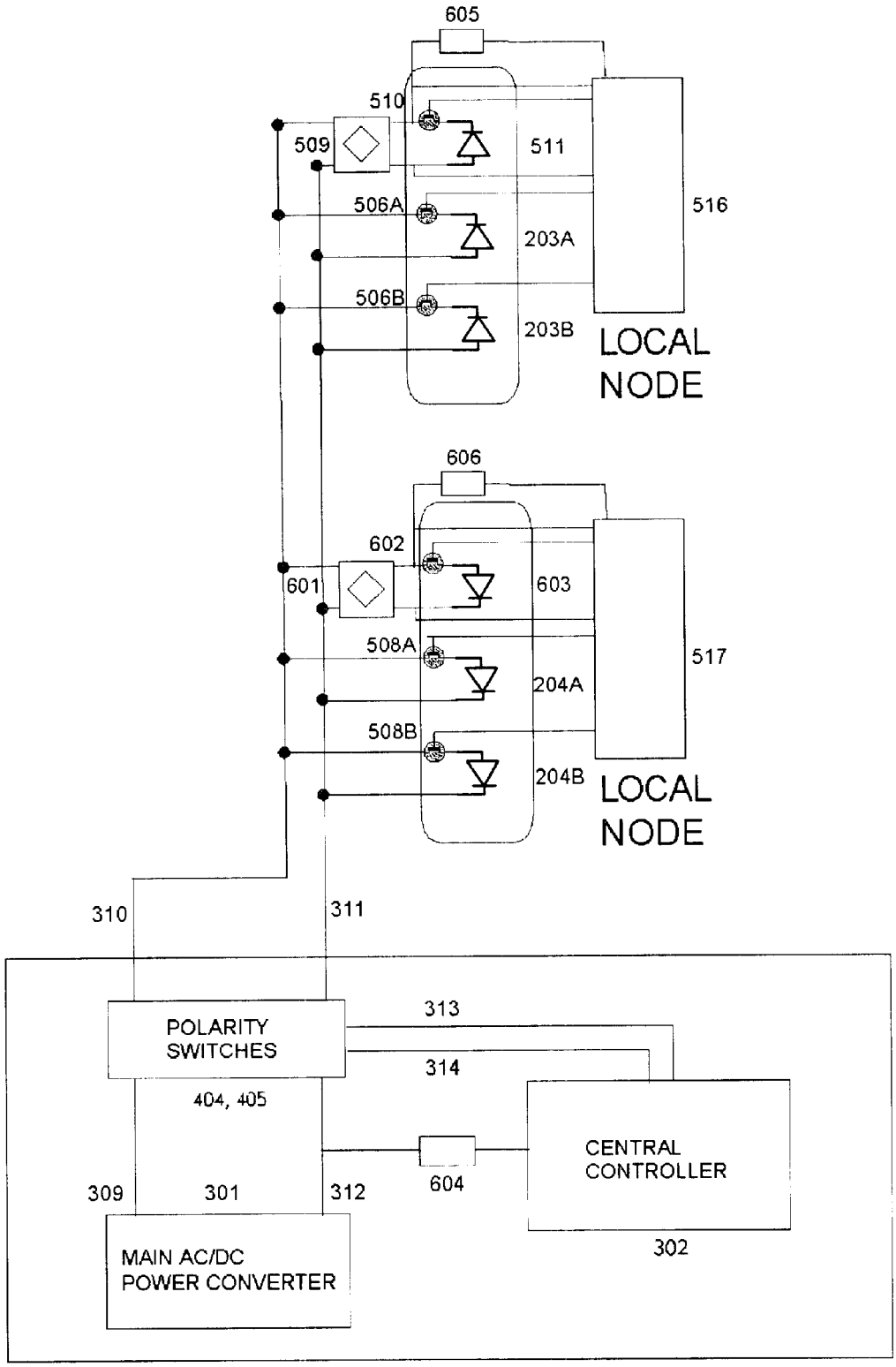
FIG. 12 is a block diagram illustrating the correspondence between to FIG. 6 and traffic signals.

FIG. 12 is a variation of FIG. 6 that shows a more typical arrangement of the signal wiring. The green and yellow signals 204*a*, 204*b* of one array are connected to receive power in one polarity, and the green and yellow signals 203*a*, 204*b* of the other array are connected to receive power in the opposed polarity. In this manner, when the arrays are associated with crossing traffic, the intrinsically safe concept assures that cross traffic do not receive the right-of-way at the same time.

Multiple Phases

FIG. 14 shows a street crossing (with streets A and B), standard traffic path numbering (paths 1 to 8) and the types of lights and devices.

In reference to FIG. 14, the following lists the paths in pairs that can be allowed for traffic at the same time without a collision hazard or accident. For example, paths 1 and 5 (1–5) can have traffic at the same time with no collision risk.

TABLE 1

Allowed phases combinations

| From Street: | Allowed phases |
|---|---|
| A | 1 and 5 |
| A | 1 and 6 |
| A | 2 and 6 |
| A | 2 and 5 |
| B | 3 and 7 |
| B | 3 and 8 |

TABLE 1-continued

| Allowed phases combinations | |
|---|---|
| From Street: | Allowed phases |
| B | 4 and 8 |
| B | 4 and 7 |

TABLE 2

| Phases in FIG. 14 = Reference numerals in FIGS. 9A and 9B | |
|---|---|
| 1 = 922 | 5 = 942 |
| 2 = 924 | 6 = 943 |
| 3 = 923 | 7 = 944 |
| 4 = 925 | 8 = 945 |

Table 3 lists all the feasible ON states for the eight signals if no polarity switches are in the OFF position for the four-power-lines arrangement (Y=14) as an extension of FIG. 7.

TABLE 3

Cables M = 4, Phases = 8 (used signals)
X = 12 (maximum signals), Y = 14 (combinations)

| D | C | B | A | 1 | 3 | 7 | 5 | 2 | 4 | 8 | 6 | 9 | 10 | 11 | 12 | Phases ON |
|---|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | 0 | X |
| 0 | 0 | 0 | 1 | 1 | 0 | 0 | 0 | 0 | 0 | 0 | 1 | 1 | 0 | 0 | 0 | 1-6-9 |
| 0 | 0 | 1 | 0 | 0 | 1 | 1 | 0 | 0 | 0 | 0 | 0 | 0 | 0 | 1 | 0 | 3-7-11 |
| 0 | 0 | 1 | 1 | 0 | 0 | 1 | 0 | 0 | 0 | 0 | 1 | 1 | 0 | 1 | 0 | 7-6-9-11 |
| 0 | 1 | 0 | 0 | 0 | 0 | 0 | 1 | 1 | 0 | 0 | 0 | 0 | 1 | 0 | 0 | 5-2-10 |
| 0 | 1 | 0 | 1 | 1 | 0 | 0 | 1 | 1 | 0 | 0 | 1 | 0 | 0 | 0 | 0 | 1-5-2-6 |
| 0 | 1 | 1 | 0 | 0 | 1 | 0 | 0 | 1 | 0 | 0 | 0 | 0 | 1 | 1 | 0 | 3-2-10-11 |
| 0 | 1 | 1 | 1 | 0 | 0 | 0 | 0 | 1 | 0 | 0 | 1 | 0 | 0 | 1 | 0 | 2-6-11 |
| 1 | 0 | 0 | 0 | 0 | 0 | 0 | 0 | 0 | 1 | 1 | 0 | 0 | 0 | 0 | 1 | 4-8-12 |
| 1 | 0 | 0 | 1 | 1 | 0 | 0 | 0 | 0 | 1 | 0 | 0 | 1 | 0 | 0 | 1 | 1-4-9-12 |
| 1 | 0 | 1 | 0 | 0 | 1 | 1 | 0 | 0 | 1 | 1 | 0 | 0 | 0 | 0 | 0 | 3-7-4-8 |
| 1 | 0 | 1 | 1 | 0 | 0 | 1 | 0 | 0 | 1 | 0 | 0 | 1 | 0 | 0 | 0 | 7-4-9 |
| 1 | 1 | 0 | 0 | 0 | 0 | 0 | 1 | 0 | 0 | 1 | 0 | 0 | 1 | 0 | 1 | 5-8-10-12 |
| 1 | 1 | 0 | 1 | 1 | 0 | 0 | 1 | 0 | 0 | 0 | 0 | 0 | 0 | 0 | 1 | 1-5-12 |
| 1 | 1 | 1 | 0 | 0 | 1 | 0 | 0 | 0 | 0 | 1 | 0 | 0 | 1 | 0 | 0 | 3-8-10 |
| 1 | 1 | 1 | 1 | 0 | 0 | 0 | 0 | 0 | 0 | 0 | 0 | 0 | 0 | 0 | 0 | X |

Connection of polar signal in table 3:

| | | |
|---|---|---|
| 1 = +A − B | 2 = −B + C | 9 = +A − C |
| 3 = +C − D | 4 = −D + A | 10 = −A + C |
| 7 = −A + B | 8 = +B − C | 11 = +B − D |
| 5 = −C + D | 6 = +D − A | 12 = −B + D |

Phases 9 to 12 are not used in example in FIG. 14.

| Usable Phases: | Phases | ON Streets |
|---|---|---|
| OK | 1-6-9 | A |
| OK | 3-7-11 | B |
| Conflict | 7-6-9-11 | AB |
| OK | 5-2-10 | A |
| Conflict | 1-5-2-6 | A |
| Conflict | 3-2-10-11 | AB |
| OK | 2-6-11 | A |
| OK | 4-8-12 | B |
| Conflict | 1-4-9-12 | AB |
| Conflict | 3-7-4-8 | B |
| OK | 7-4-9 | B |
| Conflict | 5-8-10-12 | AB |

-continued

| Usable Phases: | Phases | ON Streets |
|---|---|---|
| OK | 1-5-12 | A |
| OK | 3-8-10 | B |

"Phases" and "Streets" refer to those in FIG. 14. "Conflict" means there is the risk of a collision. In order to prevent the combination listed as "Conflict" a simplified low voltage DC monitoring system 302 is recommended.

In reference to FIG. 7, Table 4 shows the combinations feasible ON states for the six signals if no polarity switches are in the OFF position.

TABLE 4

In which M = 3, X = 6, Y = 6

| 714 | 713 | 712 | +707 | +706 | +709 | +708 | +203 | +204 | ON |
|---|---|---|---|---|---|---|---|---|---|
| 0 | 0 | 0 | 0 | 0 | 0 | 0 | 0 | 0 | X |
| 0 | 0 | 1 | 1 | 0 | 0 | 0 | 0 | 1 | 204,707 |
| 0 | 1 | 0 | 0 | 1 | 1 | 0 | 0 | 0 | 706,709 |
| 0 | 1 | 1 | 0 | 0 | 1 | 0 | 0 | 1 | 204,709 |
| 1 | 0 | 0 | 0 | 0 | 0 | 1 | 1 | 0 | 203,708 |
| 1 | 0 | 1 | 1 | 0 | 0 | 1 | 0 | 0 | 707,708 |
| 1 | 1 | 0 | 0 | 1 | 0 | 0 | 1 | 0 | 203,706 |
| 1 | 1 | 1 | 0 | 0 | 0 | 0 | 0 | 0 | X |

Figure 15A:
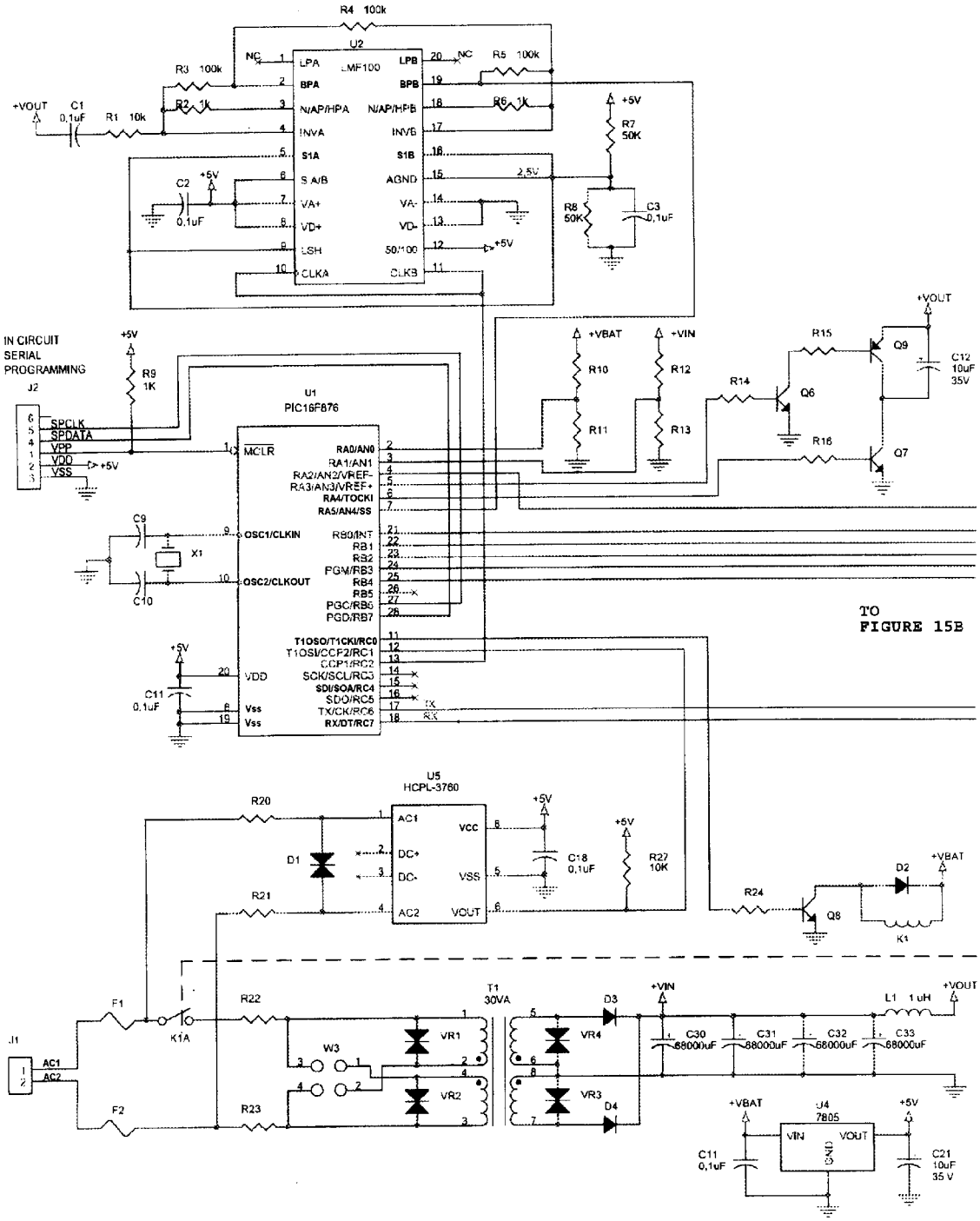
FIG. 15 is an actual circuitry used in a prototyping this invention and shows a Central Traffic Control System with elements in the fourth and fifth embodiments shown in FIGS. 5, 6 and 12.
Figure 15B:
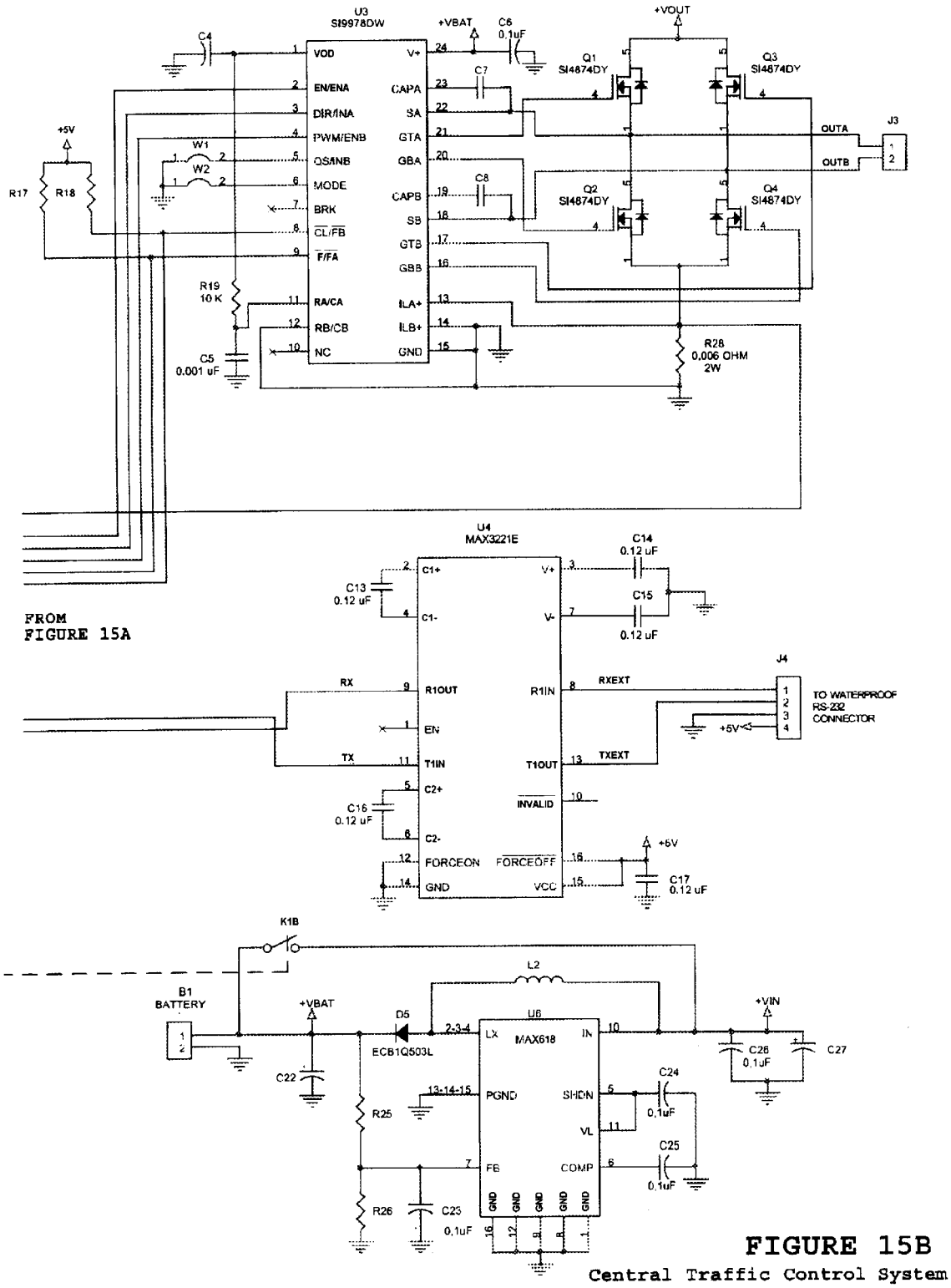

FIG. 15 is an actual circuitry used in a prototyping this invention and shows a Central Traffic Control System comprising the following elements: An AC power input (107, 117) comprising AC1 and AC2. A main power converter (301) comprising T1, F1, F2, R22, R23, W3, VR1, VR2, VR3, VR4, D3, D4, C30, C31, C32, C33 and L1. A central controller (302) comprising U1, X1, C9, C10, C11, R10, R11, R12, R13, U4, C11, C21 R9 and J2. A communication port with a possible external computer comprising U4, J4, C17, C16, C13 and C14. A communication link embedded in a power line (604) comprising R14, R15, Q6, Q7, Q9 and C12 for data transmission and, U2, C1, R1, R2, R3, C2, R4, R5, R6, R7, R8 and C3 for data reception. Polarity switches (404, 405) comprising U3, R17, R18, W1, W2, R19, C4, C5, C6, C7, C8, R28, Q1, Q2, Q3, Q4 and J3. A battery and battery charger (315) comprising U6, B1, C22, D5, R25, R26, C23, C24, C25, C26, C27, Ki, R24, Q8 and D2.

Figure 16A:
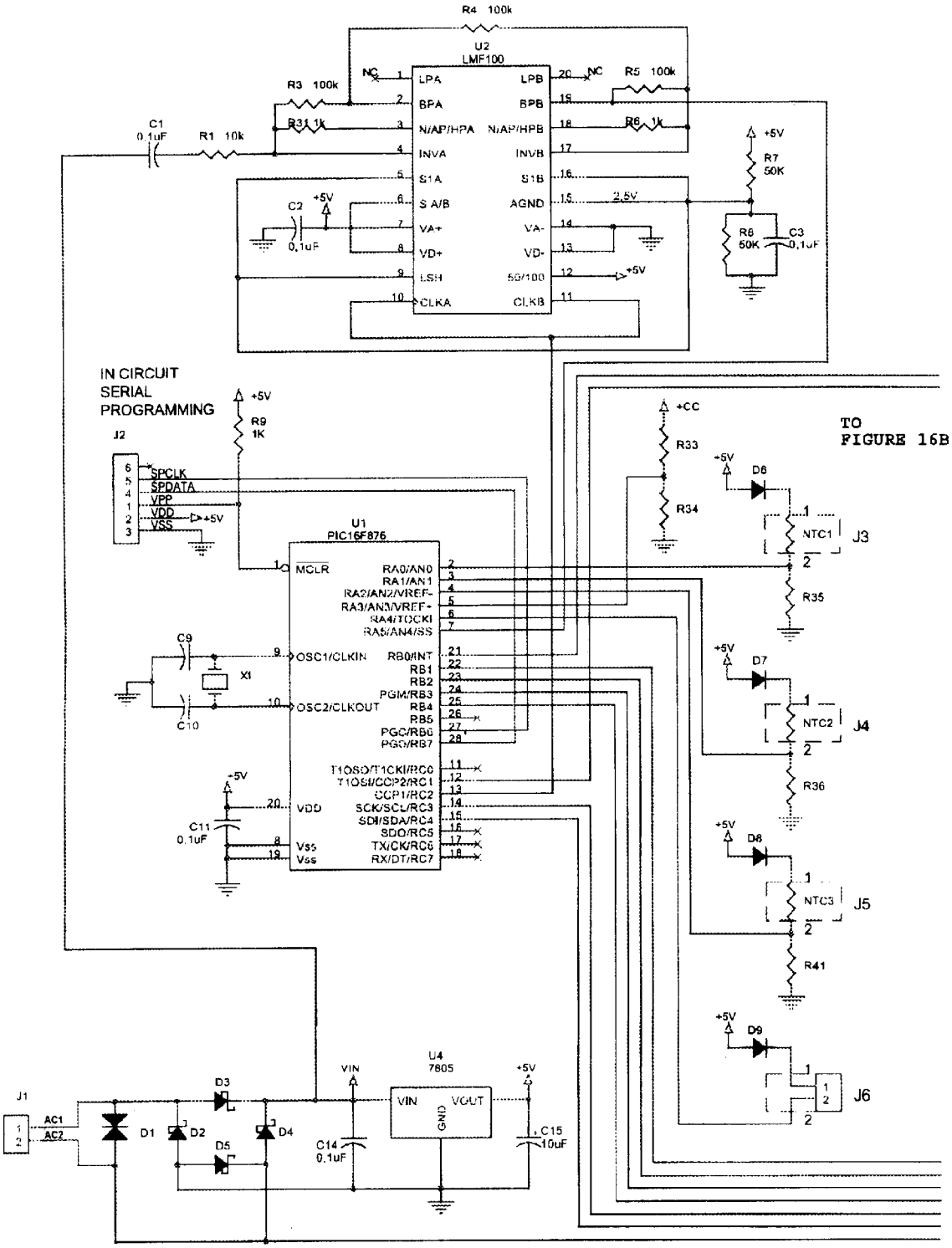
FIG. 16 is an actual circuitry used in a prototyping this invention and shows a local node and its connected elements with elements in the fourth and fifth embodiments shown in FIGS. 5, 6 and 12.
Figure 16B:
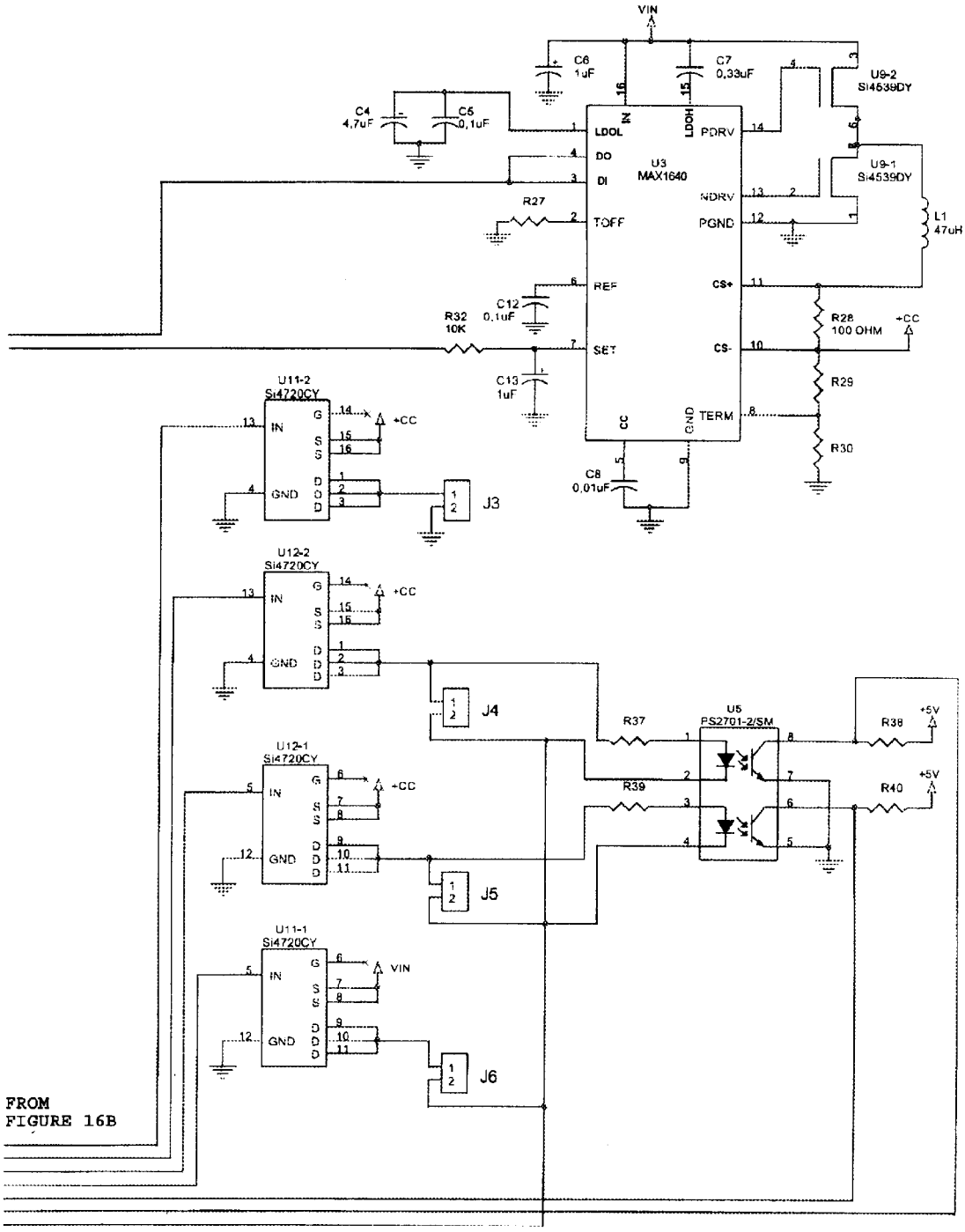

FIG. 16 is an actual circuitry used in a prototyping this invention and shows a local node and comprising the following elements: A local controller or 'node' (516, 517) comprising U1, C9, C10, X1, C11, J2, R33, R34, U4, C14, D1, D2, D3, D4, D5 and C15. An LEDs electrical conditioning system U3, C4, C5, C6, C7, C8, C12, C13, R27, R28, R29, R30, U9-1, U9-2, L1, D6, D7, D8, D9, NTC1, NTC2, NTC3, R35, R36, R41 and J6. A local monitoring system for green and yellow signals (523) comprising U5, R37, R38, R39 and R40. A set of four local switches (506, 508, 510) comprising U11-1, U11-2, U12-1, U12-2, J3, J4, J5, and J6.

It is recognized that the three main drive states signaled by a traffic control signal are to "proceed" (typically green), "proceed with caution" (typically yellow), and "stop" (typically red). However, since it is conceivable that different color associations might be established in some unusual circumstance, the three main states for traffic control will be described more generically as "proceed," "proceed with caution," and "stop."

It should be understood that various alternatives to the embodiments of the invention described herein may be employed in practicing the invention. It is intended that the following claims define the scope of the invention and that structures within the scope of these claims and their equivalents are covered thereby. While only certain preferred features of the invention have been illustrated and described, many modifications and changes will occur to those skilled in the art. It is, therefore, to be understood that the appended claims are intended to cover all such modifications and changes as fall within the true spirit of the invention.

I claim:

1. A traffic control system, comprising:

at least one pair of inherently-polarized traffic control signals (203, 204, 511, 513, 603, 706, 707, 708, 709, 922. 923, 924, 925, 942, 943, 944, 945) connected with opposite polarity orientation relative to one another;

a plurality of polarity switches (404, 405, 703, 704, 705), an output of a first one of said polarity switches (404, 405, 703, 704, 705) connected (310, 311, 712, 713, 714, 906, 909, 910, 919, 920, 921, 936, 937, 938, 939) to at least a first end of one pair of said inherently-polarized traffic control signals (203, 204, 511, 513, 603, 706, 707, 708, 709, 922. 923, 924, 925, 942, 943, 944, 945), and an output of a second one of said polarity switches (404, 405, 703, 704, 705) connected (310, 311, 712, 713, 714, 906, 909, 910, 919, 920, 921, 936, 937, 938, 939) to at least a second end of said one pair of said inherently-polarized traffic control signals (203, 204, 511, 513, 603, 706, 707, 708, 709, 922, 923, 924, 925, 942, 943, 944, 945).

2. The system of claim 1, wherein first and second members of said at least one pair of inherently-polarized traffic control signals (203, 204, 511, 513, 603, 706, 707, 708, 709, 922, 923, 924, 925, 942, 943, 944, 945) are connected with said opposite polarity orientation relative to one another, in parallel with one another (203, 204, 511, 513, 603, 706, 707, 708, 709, 922, 923, 924, 925, 942, 943, 944, 945).

3. The system of claim 1, further comprising:

a first bypass diode (1006) connected in parallel with, and in opposite polarity orientation relative to, a first member (203) of said at least one pair of inherently-polarized traffic control signals (203, 204, 511, 513, 603, 706, 707, 708, 709, 922, 923, 924, 925, 942, 943, 944, 945); and a second bypass diode (1007) connected in parallel with, and in opposite polarity orientation relative to, a second member (204) of said at least one pair of inherently-polarized traffic control signals (203, 204, 511, 513, 603, 706, 707, 708, 709, 922, 923, 924, 925, 942, 943, 944, 945); wherein:

said oppositely polarized parallel combination of said first member (203) with said first bypass diode (1006) is connected in series with said oppositely polarized parallel combination of said second member (204) with said second bypass diode (1007), such that said first (203) and second (204) members of said least one pair of inherently-polarized traffic control signals (203, 204, 511, 513, 603, 706, 707, 708, 709, 922, 923, 924, 925, 942, 943, 944, 945) are connected in said series with said opposite polarity orientation relative to one another.

4. The system of claim 1, further comprising:

at least one AC-to-DC power converter (301) converting an alternating current (107, 117) to a direct current (309, 312), and supplying said direct current (309, 312) as input to at least two of said polarity switches (404, 405, 703, 704, 705).

5. The system of claim 1, said plurality of polarity switches (404, 405, 703, 704, 705) comprising M polarity switches (404, 405, 703, 704, 705), and said at least one pair of inherently-polarized traffic control signals (203, 204, 511, 513, 603, 706, 707, 708, 709, 922, 923, 924, 925, 942, 943, 944, 945) comprising P=C(M,2) pairs of inherently-polarized traffic control signals (203, 204, 511, 513, 603, 706, 707, 708, 709, 922, 923, 924, 925, 942, 943, 944, 945), further comprising:

M cables (310, 311, 712, 713, 714) each associated with and connected to the output of one of said M polarity switches (404, 405, 703, 704, 705), delivering a direct current from its associated polarity switch (404, 405, 703, 704, 705) to one end of M-1 of said P=C(M,2) pairs of inherently-polarized traffic control signals (203, 204, 511, 513, 603, 706, 707, 708, 709, 922, 923, 924, 925, 942, 943, 944, 945), each of said M-1 pairs of inherently-polarized traffic control signals (203, 204, 511, 513, 603, 706, 707, 708, 709, 922, 923, 924, 925, 942, 943, 944, 945) connected at another end thereof to a different one of the remaining M-1 cables, thereby delivering power in pairwise combination to said first ends and said second ends of P=C(M,2) said pairs of said inherently-polarized traffic control signals (203, 204, 511, 513, 603, 706, 707, 708, 709, 922, 923, 924, 925, 942, 943, 944, 945).

6. The system of claim 1, said plurality of polarity switches (404, 405, 703, 704, 705) comprising:

at least one polarity inverter selected from the polarity inverter group consisting of: at least one non-inherently-polar polarity inverter (903, 940, 941) comprising a pair of said plurality of polarity switches (404, 405, 703, 704, 705); and at least one inherently-polar polarity inverter (905, 907) comprising another pair of said plurality of polarity switches (404, 405, 703, 704, 705); wherein:

an output of any said non-inherently-polar polarity inverter (903, 940, 941) is connected to an input of an electrical device selected from the electrical device group consisting of: at least one of said pairs of inherently-polarized traffic signals (203, 204, 511, 513, 603, 706, 707, 708, 709, 922, 923, 924, 925, 942, 943, 944, 945); at least one non-polar traffic signal (118, 199, 1102); at least one of said inherently-polar polarity inverters (905, 907); at least one of said non-inherently-polar polarity inverters (903, 940, 941); at least one of said polarity switches (404, 405, 703, 704, 705); at least one local control switch (506, 508, 510, 512, 602); at least one DC power switch (304, 305); and at least one rectifier (509, 601); and an output of any said inherently-polar polarity inverter (905, 907) is connected to an input of an electrical device selected from the electrical device group consisting of: at least one of said pairs of inherently-polarized traffic signals (203, 204, 511, 513, 603, 706, 707, 708, 709, 922, 923, 924, 925, 942, 943, 944, 945); at least one non-polar traffic signal (118, 199, 1102); at least one of said inherently-polar polarity inverters (905, 907); at least one of said non-inherently-polar polarity inverters (903, 940, 941); at least one of said polarity switches (404, 405, 703, 704, 705); at least one local control switch (506, 508, 510, 512, 602); at least one DC power switch (304, 305); and at least one rectifier (509, 601).

7. The system of claim 6, at least one of said inherently-polar polarity inverters (905, 907) comprising a non-inherently-polar polarity inverter in combination with:

a safety diode (926, 928, 1103) between two inputs (910, 911, 912, 913) thereof, in parallel thereto, and with opposite polarity orientation relative to an intended polarity orientation of said inherently-polar polarity inverter (905, 907);

a main diode (904, 906, 1101) in series with one of said two inputs (910, 912) thereof, in polarity opposite to and upstream from said safety diode (926, 928, 1103); and a current breaking device (927, 929, 1104) in series with the other one of said two inputs (911, 913) thereof, also upstream from said safety diode (926, 928, 1103);

thereby converting said non-inherently-polar polarity inverter to said at least one of said inherently-polar polarity inverters (905, 907).

8. The system of claim 1, at least one of said inherently-polarized traffic control signals (203, 204, 511, 513, 603, 706, 707, 708, 709, 922, 923, 924, 925, 942, 943, 944, 945) comprising a non-inherently-polarized traffic control signal (118, 119, 1102) in combination with:

a safety diode (926, 928, 1103) between two inputs thereof, in parallel thereto, and with opposite polarity orientation relative to an intended polarity orientation of said traffic control signal (203, 204, 511, 513, 603, 706, 707, 708, 709, 922, 923, 924, 925, 942, 943, 944, 945);

a main diode (904, 906, 1101) in series with one of said two inputs thereof, in polarity opposite to and upstream from said safety diode (926, 928, 1103); and a current breaking device (927, 929, 1104) in series with the other one of said two inputs thereof, also upstream from said safety diode (926, 928, 1103);

thereby converting said non-inherently-polarized traffic control signal (118, 119, 1102) to said at least one of said inherently-polarized traffic control signals (203, 204, 511, 513, 603, 706, 707, 708, 709, 922, 923, 924, 925, 942, 943, 944, 945).

9. The system of claim 1, further comprising:

at least one local control switch (506, 508, 510, 512, 602) connected with one of said inherently-polarized traffic control signals (203, 204, 511, 513, 603, 706, 707, 708, 709, 922, 923, 924, 925, 942, 943, 944, 945) in series combination (506, 508, 510, 512, 602), (203, 204, 511, 513); wherein:

said first end of one pair of said inherently-polarized traffic control signals (203, 204, 511, 513, 603, 706, 707, 708, 709, 922, 923, 924, 925, 942, 943, 944, 945) comprises a first end of said local control switch and traffic control signal series combination (506, 508, 510, 512, 602), (203, 204, 511, 513) and said second end of said one pair of said inherently-polarized traffic control signals (203, 204, 511, 513, 603, 706, 707, 708, 709, 922, 923, 924, 925, 942, 943, 944, 945) comprises a second end of said local control switch and traffic control signal series combination (506, 508, 510, 512, 602), (203, 204, 511, 513).

10. The system of claim 1, further comprising at least one rectifier (509, 601), local control switch (510, 602), and inherently-polarized traffic control signal (511, 603) combination, wherein:

a first corner of said rectifier (509, 601) is connected to a direct current distribution (310) from said first one of said polarity switches (404, 405, 703, 704, 705);

a third corner of said rectifier (509, 601) opposite said first corner is connected to the direct current distribution (311) from said second one of said polarity switches (404, 405, 703, 704, 705);

said local control switch (510, 602) is connected in series with said inherently-polarized traffic control signal (511, 603) of said rectifier, local switch and signal combination;

a first end of the local control switch (510, 602) and traffic control signal (511, 603) series is connected to a second corner of said rectifier (509, 601); and a second end of said local control switch (510, 602) and traffic control signal (511, 603) series is connected to a fourth corner of said rectifier (509, 601) opposite said second corner.

11. The system of claim 1, further comprising at least one rectifier (509, 601) connected across said outputs of said first and second ones of said polarity switches (404, 405, 703, 704, 705), to provide power independently of a polarity between said outputs.

12. The system of claim 1, further comprising:

at least one local control switch (512), inherently-polarized traffic control signal (513), and plurality of same-polarity-orientated diodes (514, 515) combination, wherein:

a first end of said local control switch (512) is connected directly (504) to a direct current distribution;

a second end of said local control switch (512) is connected in series to a first end of said inherently-polarized traffic control signal (513), which is polarity-oriented to enable current flow through said local control switch (513);

a second end of said inherently-polarized traffic control signal (513) is connected in same-polarity orientation series with said plurality of diodes (514, 515); and said plurality of diodes (514, 515) are thereby connected to allow current flow through said inherently-polarized traffic control signal (513) and prevent a short circuit.

13. The system of claim 1, further comprising:

at least one inherently-polarized traffic control signal (513) in which at least one power input is connected to at least two outputs (310, 311) of at least one of said polarity switches (404, 405, 703, 704, 705) using diodes in series (514, 515) to allow current flow through said inherently-polarized traffic control signal (513) and prevent short circuiting said outputs (310, 311).

14. The system of claim 1, further comprising an AC prevention device (524) connected to the output of at least one of said polarity switches (404, 405, 703, 704, 705) to prevent the polarity of said polarity switches (404, 405, 703, 704, 705) from inverting at a frequency high enough to cause retinal persistence in a human eye.

15. The system of claim 1, further comprising:

at least one controller (302) controlling at least one of said polarity switches (404, 405, 703, 704, 705).

16. The system of claim 9, further comprising:

at least one controller (302) controlling at least one of said polarity switches (404, 405, 703, 704, 705) and at least one of said local control switches (506, 508, 510, 512, 602).

17. The system of claim 10, further comprising:

at least one controller (302) controlling at least one of said polarity switches (404, 405, 703, 704, 705) and at least one of said local control switches (510).

18. The system of claim 12, further comprising:

at least one controller (302) controlling at least one of said polarity switches (404, 405, 703, 704, 705) and at least one of said local control switches (512).

19. The system of claim 1, further comprising:

at least one controller (302) controlling at least one of said polarity switches (404, 405, 703, 704, 705); and at least one monitoring system (303) monitoring at least one current characteristic selected from the current characteristic group consisting of: value, voltage, polarity, sequencing and timing, of a direct current output of at least one of said polarity switches (404, 405, 703, 704, 705), and providing information (315) about said monitoring to at least one of said controllers (302).

20. The system of claim 1, wherein:

one member of given one of said pairs of inherently-polarized traffic control signals (203, 204, 511, 513, 603, 706, 707, 708, 709, 922, 923, 924, 925, 942, 943, 944, 945) signals a first roadway to allow traffic to pass;

the other, oppositely polarized member of said given one of said pairs of inherently-polarized traffic control signals (203, 204, 511, 513, 603, 706, 707, 708, 709, 922, 923, 924, 925, 942, 943, 944, 945) signals a second roadway in conflict with said first roadway to allow traffic to pass; and it is thereby impossible to simultaneously signal both said first roadway and said second roadway to allow traffic to pass, resulting in intrinsically-safe traffic control of these conflicting roadways.

21. The system of claim 9, wherein:

one member of given one of said pairs of inherently-polarized traffic control signals (203, 204, 511, 513, 603, 706, 707, 708, 709, 922, 923, 924, 925, 942, 943, 944, 945) signals a first roadway to allow traffic to pass;

the other, oppositely polarized member of said given one of said pairs of inherently-polarized traffic control signals (203, 204, 511, 513, 603, 706, 707, 708, 709, 922, 923, 924, 925, 942, 943, 944, 945) signals a second roadway in conflict with said first roadway to allow traffic to pass;

at least one (506, 508) of said local control switches (506, 508, 510, 512, 602) is used to control as between the signal allowing traffic to pass being a "proceed" signal, and its being a "proceed with caution" signal;

it is thereby impossible to simultaneously signal both said first roadway and said second roadway to allow traffic to pass, resulting in intrinsically-safe traffic control of these conflicting roadways.

22. The system of claim 10, wherein said inherently-polarized traffic control signal (511, 603) of said combination is a "stop" signal.

23. The system of claim 12, wherein said inherently-polarized traffic control signal (513) of said combination is a "stop" signal.

24. The system of claim 1, further comprising at least one low dropout voltage diode (509, 514, 515, 601, 904, 906, 1006, 1007, 1101) in series combination with at least one high-current flow path thereof.

25. The system of claim 1, further comprising a local monitoring device (523) monitoring a state of at least one of said inherently-polarized traffic control signals (203, 204, 511, 513, 603, 706, 707, 708, 709, 922, 923, 924, 925, 942, 943, 944, 945).

26. The system of claim 25, wherein said local monitoring device (523) monitors said state of said at least one of said inherently-polarized traffic control signals (203, 204, 511, 513, 603, 706, 707, 708, 709, 922, 923, 924, 925, 942, 943, 944, 945) by monitoring at least one current characteristic selected from the current characteristic group consisting of: value, voltage, polarity, sequencing and timing, of a power input of said at least one of said inherently-polarized traffic control signals (203, 204, 511, 513, 603, 706, 707, 708, 709, 922, 923, 924, 925, 942, 943, 944, 945) and provides information (522) about said monitoring to at least one local node (516, 517) and ultimately to at least one controller (302).

27. The system of claim 1, further comprising:

at least one controller (302) controlling at least one of said polarity switches (404, 405, 703, 704, 705) connected to an output of at least one AC-to-DC power converter (301) and to an input of at least one of said inherently-polarized traffic control signals (203, 204, 511, 513, 603, 706, 707, 708, 709, 922, 923, 924, 925, 942, 943, 944, 945).

28. The system of claim 1, further comprising:

at least one controller (302) controlling at least one of said polarity switches (404, 405, 703, 704, 705) connected to an output of at least one AC-to-DC power converter (301) and to an input of at least one of said inherently-polarized traffic control signals (203, 204, 511, 513, 603, 706, 707, 708, 709, 922, 923, 924, 925, 942, 943, 944, 945); and at least one monitoring system (303) monitoring at least one current characteristic selected from the current characteristic group consisting of: value, voltage, polarity, sequencing and timing, of a direct current output of at least one of said polarity switches (404, 405, 703, 704, 705), and providing information (315) about said monitoring to at least one of said controllers (302).

29. The system of claim 1, further comprising at least one battery and battery charger (316) connected to outputs of at least one AC-to-DC power converter (301).

30. The system of claim 1, further comprising at least one in-line communication device (604, 605, 606) modulating and demodulating an AC waveform over DC power lines (309, 312) of said system to control at least one local control switch (506, 508, 510, 512, 602) of said system.

31. A method of interconnecting traffic control signals to control traffic, comprising the steps of:

connecting at least one pair of inherently-polarized traffic control signals (203, 204, 511, 513, 603, 706, 707, 708, 709, 922, 923, 924, 925, 942, 943, 944, 945) with opposite polarity orientation relative to one another;

connecting (310, 311, 712, 713, 714, 906, 909, 910, 919, 920, 921, 936, 937, 938, 939) an output of a first one of a plurality of polarity switches (404, 405, 703, 704, 705) to at least a first end of one pair of said inherently-polarized traffic control signals (203, 204, 511, 513, 603, 706, 707, 708, 709, 922, 923, 924, 925, 942, 943, 944, 945); and connecting (310, 311, 712, 713, 714, 906, 909, 910, 919, 920, 921, 936, 937, 938, 939) an output of a second one of said polarity switches (404, 405, 703, 704, 705) to at least a second end of said one pair of said inherently-polarized traffic control signals (203, 204, 511, 513, 603, 706, 707, 708, 709, 922, 923, 924, 925, 942, 943, 944, 945).

32. The method of claim 31, further comprising the step of:

connecting first and second members of said at least one pair of inherently-polarized traffic control signals (203, 204, 511, 513, 603, 706, 707, 708, 709, 922, 923, 924, 925, 942, 943, 944, 945) with said opposite polarity orientation relative to one another, in parallel with one another (203, 204, 511, 513, 603, 706, 707, 708, 709, 922, 923, 924, 925, 942, 943, 944, 945).

33. The method of claim 31, further comprising the steps of:

connecting a first bypass diode (1006) in parallel with, and in opposite polarity orientation relative to, a first member (203) of said at least one pair of inherently-polarized traffic control signals (203, 204, 511, 513, 603, 706, 707, 708, 709, 922, 923, 924, 925, 942, 943, 944, 945); and connecting a second bypass diode (1007) in parallel with, and in opposite polarity orientation relative to, a second member (204) of said at least one pair of inherently-polarized traffic control signals (203, 204, 511, 513, 603, 706, 707, 708, 709, 922, 923, 924, 925, 942, 943, 944, 945); and connecting said oppositely polarized parallel combination of said first member (203) with said first bypass diode (1006) in series with said oppositely polarized parallel combination of said second member (204) with said second bypass diode (1007), such that said first (203) and second (204) members of said least one pair of inherently-polarized traffic control signals (203, 204, 511, 513, 603, 706, 707, 708, 709, 922, 923, 924, 925, 942, 943, 944, 945) are connected in said series with said opposite polarity orientation relative to one another.

34. The method of claim 31, further comprising the steps of:

converting an alternating current (107, 117) to a direct current (309, 312) using at least one AC-to-DC power converter (301); and supplying said direct current (309, 312) as input to at least two of said polarity switches (404, 405, 703, 704, 705).

35. The method of claim 31, said plurality of polarity switches (404, 405, 703, 704, 705) comprising M polarity switches (404, 405, 703, 704, 705), and said at least one pair of inherently-polarized traffic control signals (203, 204, 511, 513, 603, 706, 707, 708, 709, 922, 923, 924, 925, 942, 943, 944, 945) comprising P=C(M,2) pairs of inherently-polarized traffic control signals (203, 204, 511, 513, 603, 706, 707, 708, 709, 922, 923, 924, 925, 942, 943, 944, 945), further comprising the steps of:

delivering a direct current from its associated polarity switch (404, 405, 703, 704, 705) to one end of M-1 of said P=C(M,2) pairs of inherently-polarized traffic control signals (203, 204, 511, 513, 603, 706, 707, 708, 709, 922, 923, 924, 925, 942, 943, 944, 945) using M cables (310, 311, 712, 713, 714) each associated with and connected to the output of one of said M polarity switches (404, 405, 703, 704, 705), by connecting each of said M-1 pairs of inherently-polarized traffic control signals (203, 204, 511, 513, 603, 706, 707, 708, 709, 922, 923, 924, 925, 942, 943, 944, 945) at another end thereof to a different one of the remaining M-1 cables, thereby delivering power in pairwise combination to said first ends and said second ends of P=C(M,2) said pairs of said inherently-polarized traffic control signals (203, 204, 511, 513, 603, 706, 707, 708, 709, 922, 923, 924, 925, 942, 943, 944, 945).

36. The method of claim 31, said plurality of polarity switches (404, 405, 703, 704, 705) comprising at least one polarity inverter selected from the polarity inverter group consisting of: at least one non-inherently-polar polarity inverter (903, 940, 941) comprising a pair of said plurality of polarity switches (404, 405, 703, 704, 705); and at least one inherently-polar polarity inverter (905, 907) comprising another pair of said plurality of polarity switches (404, 405, 703, 704, 705); comprising the further steps of:

connecting an output of any said non-inherently-polar polarity inverter (903, 940, 941) to an input of an electrical device selected from the electrical device group consisting of:

at least one of said pairs of inherently-polarized traffic signals (203, 204, 511, 513, 603, 706, 707, 708, 709, 922, 923, 924, 925, 942, 943, 944, 945); at least one non-polar traffic signal (118, 199, 1102); at least one of said inherently-polar polarity inverters (905, 907); at least one of said non-inherently-polar polarity inverters (903, 940, 941); at least one of said polarity switches (404, 405, 703, 704, 705); at least one local control switch (506, 508, 510, 512, 602); at least one DC power switch (304, 305); and at least one rectifier (509, 601); and connecting an output of any said inherently-polar polarity inverter (905, 907) to an input of an electrical device selected from the electrical device group consisting of: at least one of said pairs of inherently-polarized traffic signals (203, 204, 511, 513, 603, 706, 707, 708, 709, 922, 923, 924, 925, 942, 943, 944, 945); at least one non-polar traffic signal (118, 199, 1102); at least one of said inherently-polar polarity inverters (905, 907); at least one of said non-inherently-polar polarity inverters (903, 940, 941); at least one of said polarity switches (404, 405, 703, 704, 705); at least one local control switch (506, 508, 510, 512, 602); at least one DC power switch (304, 305); and at least one rectifier (509, 601).

37. The method of claim 36, further comprising the step of converting at least one of said non-inherently-polar polarity inverters to a said inherently-polar polarity inverter (905, 907) by:

connecting a safety diode (1103) between two inputs (910, 911, 912, 913) of said at least one of said non-inherently-polar polarity inverters, in parallel thereto, and with opposite polarity orientation relative to an intended polarity orientation of said inherently-polar polarity inverter (905, 907);

connecting a main diode (1101) in series with one of said two inputs (910, 911, 912, 913) thereof, in polarity opposite to and upstream from said safety diode (1103); and connecting a current breaking device (1104) in series with the other one of said two inputs (910, 911, 912, 913) thereof, also upstream from said safety diode (1103).

38. The method of claim 31, further comprising the step of converting at least one non-inherently-polarized traffic control signal (118, 119, 1102) to at least one of said inherently-polarized traffic control signals (203, 204, 511, 513, 603, 706, 707, 708, 709, 922, 923, 924, 925, 942, 943, 944, 945) by:

connecting a safety diode (1103) between two inputs of said at least one non-inherently-polarized traffic control signal (118, 119, 1102), in parallel thereto, and with opposite polarity orientation relative to an intended polarity orientation of said traffic control signal (203, 204, 511, 513, 603, 706, 707, 708, 709, 922, 923, 924, 925, 942, 943, 944, 945);

connecting a main diode (1101) in series with one of said two inputs thereof, in polarity opposite to and upstream from said safety diode (1103); and connecting a current breaking device (1104) in series with the other one of said two inputs thereof, also upstream from said safety diode (1103).

39. The method of claim 31, further comprising the step of:

connecting at least one local control switch (506, 508, 510, 512, 602) with one of said inherently-polarized traffic control signals (203, 204, 511, 513, 603, 706, 707, 708, 709, 922, 923, 924, 925, 942, 943, 944, 945) in series combination (506, 508, 510, 512, 602), (203, 204, 511, 513); wherein:

said first end of one pair of said inherently-polarized traffic control signals (203, 204, 511, 513, 603, 706, 707, 708, 709, 922, 923, 924, 925, 942, 943, 944, 945) comprises a first end of said local control switch and traffic control signal series combination (506, 508, 510, 512, 602), (203, 204, 511, 513) and said second end of said one pair of said inherently-polarized traffic control signals (203, 204, 511, 513, 603, 706, 707, 708, 709, 922, 923, 924, 925, 942, 943, 944, 945) comprises a second end of said local control switch and traffic control signal series combination (506, 508, 510, 512, 602), (203, 204, 511, 513).

40. The method of claim 31, further comprising the steps of:

connecting a first corner of a rectifier (509, 601) to a direct current distribution (310) from said first one of said polarity switches (404, 405, 703, 704, 705);

connecting a third corner of said rectifier (509, 601) opposite said first corner to the direct current distribution (311) from said second one of said polarity switches (404, 405, 703, 704, 705);

connecting a local control switch (510, 602) in series with an inherently-polarized traffic control signal (511, 603) of a combination of said rectifier (509, 601), said local control switch (510, 602) and said inherently-polarized traffic control signal (511, 603);

connecting a first end of the local control switch (510, 602) and traffic control signal (511, 603) series to a second corner of said rectifier (509, 601); and connecting a second end of said local control switch (510, 602) and traffic control signal (511, 603) series to a fourth corner of said rectifier (509, 601) opposite said second corner.

41. The method of claim 31, further comprising the step of: connecting at least one rectifier (509, 601) across said outputs of said first and second ones of said polarity switches (404, 405, 703, 704, 705), to provide power independently of a polarity between said outputs.

42. The method of claim 31, further comprising the steps of:

connecting a first end of a local control switch (512) directly (504) to a direct current distribution;

connecting a second end of said local control switch (512) in series to a first end of an inherently-polarized traffic control signal (513), which is polarity-oriented to enable current flow through said local control switch (513); and connecting a second end of said inherently-polarized traffic control signal (513) in same-polarity orientation series with a plurality of same-polarity-orientated diodes (514, 515); wherein:

said plurality of diodes (514, 515) are connected to allow current flow through said inherently-polarized traffic control signal (513) and prevent a short circuit.

43. The method of claim 31, further comprising the step of:

connecting at least one power input of at least one inherently-polarized traffic control signal (513) to at least two outputs (310, 311) of at least one of said polarity switches (404, 405, 703, 704, 705) using diodes in series (514, 515) to allow current flow through said inherently-polarized traffic control signal (513) and prevent short circuiting said outputs (310, 311).

44. The method of claim 31, further comprising the step of:

connecting an AC prevention device (524) the output of at least one of said polarity switches (404, 405, 703, 704, 705) to prevent the polarity of said polarity switches (404, 405, 703, 704, 705) from inverting at a frequency high enough to cause retinal persistence in a human eye.

45. The method of claim 31, further comprising the step of:

controlling at least one of said polarity switches (404, 405, 703, 704, 705) using at least one controller (302).

46. The method of claim 39, further comprising the step of:

controlling at least one of said polarity switches (404, 405, 703, 704, 705) and at least one of said local control switches (506, 508, 510, 512, 602) using at least one controller (302).

47. The method of claim 40, further comprising the step of:

controlling at least one of said polarity switches (404, 405, 703, 704, 705) and at least one of said local control switches (510) using at least one controller (302).

48. The method of claim 42, further comprising the step of:

controlling at least one of said polarity switches (404, 405, 703, 704, 705) and at least one of said local control switches (512) using at least one controller (302).

49. The method of claim 31, further comprising the steps of:

controlling at least one of said polarity switches (404, 405, 703, 704, 705) using at least one controller (302); and monitoring at least one current characteristic selected from the current characteristic group consisting of: value, voltage, polarity, sequencing and timing, of a direct current output of at least one of said polarity switches (404, 405, 703, 704, 705), using at least one monitoring system (303); and providing information (315) about said monitoring to at least one of said controllers (302).

50. The method of claim 31, further comprising the steps of:

signaling a first roadway to allow traffic to pass, using one member of given one of said pairs of inherently-polarized traffic control signals (203, 204, 511, 513, 603, 706, 707, 708, 709, 922, 923, 924, 925, 942, 943, 944, 945);

signaling a second roadway in conflict with said first roadway to allow traffic to pass using the other, oppositely polarized member of said given one of said pairs of inherently-polarized traffic control signals (203, 204, 511, 513, 603, 706, 707, 708, 709, 922, 923, 924, 925, 942, 943, 944, 945); wherein:

it is thereby impossible to simultaneously signal both said first roadway and said second roadway to allow traffic to pass, resulting in intrinsically-safe traffic control of these conflicting roadways.

51. The method of claim 39, further comprising the steps of:

signaling a first roadway to allow traffic to pass using one member of given one of said pairs of inherently-polarized traffic control signals (203, 204, 511, 513, 603, 706, 707, 708, 709, 922, 923, 924, 925, 942, 943, 944, 945);

signaling a second roadway in conflict with said first roadway to allow traffic to pass using the other, oppositely polarized member of said given one of said pairs of inherently-polarized traffic control signals (203, 204, 511, 513, 603, 706, 707, 708, 709, 922, 923, 924, 925, 942, 943, 944, 945); and controlling as between the signal allowing traffic to pass being a "proceed" signal, and its being a "proceed with caution" signal, using at least one (506, 508) of said local control switches (506, 508, 510, 512, 602); wherein:

it is thereby impossible to simultaneously signal both said first roadway and said second roadway to allow traffic to pass, resulting in intrinsically-safe traffic control of these conflicting roadways.

52. The method of claim 40, wherein said inherently-polarized traffic control signal (511, 603) of said combination is a "stop" signal.

53. The method of claim 42, wherein said inherently-polarized traffic control signal (513) of said combination is a "stop" signal.

54. The method of claim 31, further comprising the step of:

connecting at least one low dropout voltage diode (509, 514, 515, 601, 904, 906, 1006, 1007, 1101) in series combination with at least one high-current flow path of an interconnected system of said traffic control signals.

55. The method of claim 31, further comprising the step of:

monitoring a state of at least one of said inherently-polarized traffic control signals (203, 204, 511, 513, 603, 706, 707, 708, 709, 922, 923, 924, 925, 942, 943, 944, 945) using a local monitoring device (523).

56. The method of claim 55, further comprising the steps of:

monitoring said state of said at least one of said inherently-polarized traffic control signals (203, 204, 511, 513, 603, 706, 707, 708, 709, 922, 923, 924, 925, 942, 943, 944, 945), by monitoring at least one current characteristic selected from the current characteristic group consisting of: value, voltage, polarity, sequencing and timing, of a power input of said at least one of said inherently-polarized traffic control signals (203, 204, 511, 513, 603, 706, 707, 708, 709, 922, 923, 924, 925, 942, 943, 944, 945), using said local monitoring device (523); and providing information (522) about said monitoring to at least one local node (516, 517) and ultimately to at least one controller (302).

57. The method of claim 31, further comprising the steps of:

connecting at least one of said polarity switches (404, 405, 703, 704, 705) to an output of at least one AC-to-DC power converter (301) and to an input of at least one of said inherently-polarized traffic control signals (203, 204, 511, 513, 603, 706, 707, 708, 709, 922, 923, 924, 925, 942, 943, 944, 945); and controlling said at least one of said polarity switches (404, 405, 703, 704, 705) using at least one controller (302).

58. The method of claim 31, further comprising the steps of:

connecting at least one of said polarity switches (404, 405, 703, 704, 705) to an output of at least one AC-to-DC power converter (301) and to an input of at least one of said inherently-polarized traffic control signals (203, 204, 511, 513, 603, 706, 707, 708, 709, 922, 923, 924, 925, 942, 943, 944, 945);

controlling said at least one of said polarity switches (404, 405, 703, 704, 705) using at least one controller (302);

monitoring at least one current characteristic selected from the current characteristic group consisting of: value, voltage, polarity, sequencing and timing, of a direct current output of at least one of said polarity switches (404, 405, 703, 704, 705), using at least one monitoring system (303); and providing information (315) about said monitoring to at least one of said controllers (302).

59. The method of claim 31, further comprising the step of:

connecting at least one battery and battery charger (316) to outputs of at least one AC-to-DC power converter (301).

60. The method of claim 31, further comprising the step of: modulating and demodulating an AC waveform over DC power lines (309, 312) interconnecting said traffic control signals to control at least one local control switch (506, 508, 510, 512, 602), using at least one in-line communication device (604, 605, 606).

* * * * *